US011624208B2

(12) United States Patent
Shumaker et al.

(10) Patent No.: US 11,624,208 B2
(45) Date of Patent: Apr. 11, 2023

(54) DOOR LOCK HAVING A LIGHTED DISPLAY WHEN IN THE LOCKED POSITION

(71) Applicant: Oak Security Group LLC, Indianapolis, IN (US)

(72) Inventors: Mark A. Shumaker, Indianapolis, IN (US); Roger K. Russell, Indianapolis, IN (US); Chung-Liang Lin, Tianan (TW)

(73) Assignee: Oak Security Group LLC, Indianapolis, IN (US)

( * ) Notice: Subject to any disclaimer, the term of this patent is extended or adjusted under 35 U.S.C. 154(b) by 118 days.

(21) Appl. No.: 16/911,276

(22) Filed: Jun. 24, 2020

(65) Prior Publication Data

US 2021/0079688 A1 Mar. 18, 2021

Related U.S. Application Data

(63) Continuation-in-part of application No. 16/383,756, filed on Apr. 15, 2019.

(Continued)

(51) Int. Cl.

| | |
|---|---|
| ***E05B 41/00*** | (2006.01) |
| ***E05B 55/00*** | (2006.01) |
| ***E05B 17/10*** | (2006.01) |

(52) U.S. Cl.

CPC ..... *E05B 41/00* (2013.01); *E05B 17/10* (2013.01); *E05B 55/00* (2013.01); *E05Y 2400/612* (2013.01); *E05Y 2900/132* (2013.01)

(58) Field of Classification Search

CPC ..... E05B 17/10; E05B 17/106; E05B 39/00; E05B 41/00; E05B 55/00

See application file for complete search history.

(56) References Cited

U.S. PATENT DOCUMENTS 3,803,575 A * 4/1974 Gotanda ..... E05B 45/083 340/542
4,683,741 A * 8/1987 Fields ..... E05B 17/10 70/432

(Continued)

*Primary Examiner* — Christopher J Boswell

(74) *Attorney, Agent, or Firm* — Indiano Law Group LLC; E. Victor Indiano

(57) ABSTRACT

A locking mechanism is provided for a portal closure that includes a first side, and a second side The portal closure including a latch movable into and out of engagement with a latch receiver and a latch driving device coupled to the latch for moving the latch into and out of engagement with the latch receiver The latch driving device includes a controllable lock member movable between a locked position where the latch is fixedly positioned in the latch receiver and an unlocked position where the latch is capable of being disengaged from the latch receiver and a second side latch driving device mover disposed on the second side of the portal closure. The locking mechanism includes a first side latch driving device mover disposed on the first side of the portal closures, and coupled to the latch driving device for moving the latch driving device to cause the latch to move into and out of engagement with the latch receiver. A signal generator is provided for generating a human detectable signal. A lock actuator is coupled to the controllable lock member for moving the locking mechanism between a first normal position wherein the second side lock driving device is capable of being moved between an unlocked position to permit the latch to be disengaged from the latch receiver and a locked position where the latch is prevented from being disengaged from the latch receiver; and a second emergency position wherein the second side lock driving device is in the locked position, and the signal generator is actuated to generate a human detectable signal. A power source is provided for powering the signal generator when the locking mechanism is in the second emergency position. A switch is coupled between the power source and the signal generator for controlling the flow of current between the power source and the signal generator.

22 Claims, 20 Drawing Sheets

Related U.S. Application Data

(60) Provisional application No. 62/886,827, filed on Aug. 14, 2019, provisional application No. 62/866,521, filed on Jun. 25, 2019.

(56) References Cited

U.S. PATENT DOCUMENTS

| | | | | | |
|---|---|---|---|---|---|
| 4,760,380 | A * | 7/1988 | Quenneville | E05B 17/10 | 340/542 |
| 5,179,325 | A * | 1/1993 | Aragon, Jr. | E05B 17/10 | 362/100 |
| 5,398,175 | A * | 3/1995 | Pea | E05B 17/10 | 362/100 |
| 6,993,945 | B1 * | 2/2006 | Chen | E05B 13/101 | 70/222 |
| 8,590,949 | B2 * | 11/2013 | Wang | E05B 55/005 | 292/336.3 |
| 9,758,990 | B2 * | 9/2017 | Beck | E05B 17/22 | |
| 9,879,445 | B2 * | 1/2018 | Gopalakrishnan | E05B 55/005 | |
| 10,151,122 | B2 * | 12/2018 | Marks | E05B 17/10 | |
| 10,240,363 | B2 * | 3/2019 | Hsu | E05B 17/10 | |
| 10,342,090 | B2 * | 7/2019 | Noeldner | E05B 17/10 | |
| 10,563,425 | B2 | 2/2020 | Lunday | | |
| 2020/0002977 | A1 * | 1/2020 | Russi-Vigoya | E05B 39/00 | |

* cited by examiner

DOOR LOCK HAVING A LIGHTED DISPLAY WHEN IN THE LOCKED POSITION

I. RELATED APPLICATIONS

This application is a continuation-in-part of U.S. Non-Provisional patent application Ser. No. 16/383,756 which was filed on 19 Apr. 2019. This application also claims benefit to U.S. Provisional Patents Ser. No. 62/866,521 of Mark Shumaker and Roger K. Russell filed on 25 Jun. 2019; and U.S. Provisional Patents Ser. No. 62/886,827 of Mark Shumaker and Roger K. Russell filed on 14 Aug. 2019, all of which above applications are incorporated into and made a part of this application

II. FIELD OF THE INVENTION

The present invention relates to locking mechanisms for portal closures such as doors, and more particularly to a door locking system having an illuminated indication of lock status.

III. BACKGROUND OF INVENTION

Locks for portal closures such as doors have existed for centuries. A wide variety of locks are known currently to serve a wide variety of situations. The locks that exist today vary both in the manner they operate and in their aesthetics.

Currently, the most popular type of locks in use are key-actuated locks. A key-actuated lock includes a housing and a latch driving device having an axially extending passageway for receiving a rotatable cylinder that often includes a plurality of radially moveable pins. The cylinder includes an axially extending opening into which a key is inserted. They key has an irregular surface for engaging the pins. When the appropriate key is inserted into the key slot of the cylinder, the surfaces of the key move the pins an appropriate radial distance so that the pins line up in a manner that allows the cylinder to rotate within its housing.

When the cylinder is moved to an unlocked position, the handle of the door lock can move the latch mechanism of the door lock, so that the latch can be moved out of engagement with the receiver plate that is coupled to the frame of the door into which the door is mounted. This allows the door to be moved between an opened and closed position.

With most lock configurations, the movement of the door handle actuates the latch to move inwardly and outwardly through the latch driving device. However, in other configurations the movement of the cylinder can cause the latch to move inwardly and outwardly. Latches can include such mechanisms as spring-loaded latches and deadbolts.

In recent years, the need has arisen for security systems in classrooms and other high risk areas that can be quickly and securely locked to prevent room intrusions in emergency situations, such as situations where "shooters" or terrorists gain access to a building in an attempt to cause damage and death to students, teachers, and property. Various methods have been developed to provide a method for securely locking doors, such as classroom doors, in shooter situations.

One such method involves the implementation of existing technology, such as by employing a deadbolt or lock system that enables the door to be locked from the interior of the room, but only unlocked from the exterior of the room with a key. Such systems are believed to work well because it is unlikely that an unauthorized person such as terrorist or school shooter will have a key for the doors. Thus, locking the doors from inside will usually do an adequate job of keeping an intruder outside the classroom or at least require the intruder to break down the door to gain access to the room.

One method for providing such a system includes a deadbolt type system wherein the door requires a key to lock or unlock the locking system from both the outside and inside of the door. In an emergency situation, the teacher would take the key, go to the door, and lock it with her key. The keyed-on-both-sides system has the advantage of making it more difficult for a person in the classroom to lock others out of the classroom, such as a terrorist.

Although this type of system works well from a mechanical standpoint, it has drawbacks from a practical standpoint. In particular, in an emergency situation, it is crucial to have the door locked as quickly as possible. Often, a teacher may not be close to her desk, and therefore, valuable time can be wasted because of the time required for the teacher to move from her position in the classroom to the desk where she probably keeps the key, and then to the door to lock it.

Because such emergency situations are so rare, a strong likelihood exists that the "emergency" key to lock the door will become lost, or misplaced. In that case, the time required to look for the key could add to the time period between the sounding of an emergency alarm and the time when the door was locked against outside attackers.

One method for improving on this prior discussed system is to provide a thumb lock that can be actuated without a key to lock the door from the interior side, with no corresponding lock actuator, or only a key actuated actuator on the outside. This thumb lock has the advantage over the key lock system as it would not require a teacher to first find the key before locking the door. Additionally, such a door could be locked by a student who might be positioned closer to the lock than the teacher, and thus be able to lock the door more quickly. However, this system also contains certain drawbacks.

One drawback is that there is no indicator on the door to ensure that the door is locked. As such, if a student were to lock the door incorrectly, there is no way for the teacher to verify that the door is locked correctly without testing the door herself. Nor is there any way for the student to know by sight whether he has locked the door correctly. Therefore, room for improvement exists.

One object of the present invention is to produce a lock device having an indicium that will indicate if the lock is in an appropriate position, such as being locked and/or unlocked. Preferable, this lock is designed to not only work with "new lock" installations but can also be retrofit onto existing locks. By enabling the indicia containing lock device to be retrofit onto existing locks, the user may be able to save money by avoiding replacing the entire lock mechanism to obtain the indicia features of the present invention, while only adding a handle portion.

IV. SUMMARY OF THE INVENTION

In accordance with the present invention, a locking mechanism for a portal closure that includes a first side, and a second side The portal closure including a latch movable into and out of engagement with a latch receiver and a latch driving device coupled to the latch for moving the latch into and out of engagement with the latch receiver The latch driving device includes a controllable lock member movable between a locked position where the latch is fixedly positioned in the latch receiver and an unlocked position where the latch is capable of being disengaged from the latch receiver and a second side latch driving device mover disposed on the second side of the portal closure. The locking mechanism comprises a first side latch driving device mover disposed on the first side of the portal closures, and coupled to the latch driving device for moving the latch driving device to cause the latch to move into and out of engagement with the latch receiver. A signal generator is provided for generating a human detectable signal. A lock actuator is coupled to the controllable lock member for moving the locking mechanism between a first normal position wherein the second side lock driving device is capable of being moved between an unlocked position to permit the latch to be disengaged from the latch receiver and a locked position where the latch is prevented from being disengaged from the latch receiver; and a second emergency position wherein the second side lock driving device is in the locked position, and the signal generator is actuated to generate a human detectable signal. A power source is provided for powering the signal generator when the locking mechanism is in the second emergency position. A switch is coupled between the power source and the signal generator for controlling the flow of current between the power source and the signal generator.

Preferably, the signal generator comprises a light that includes a power source for powering the light. A switch can be provided for electrically coupling and decoupling a light and the power source. The power source can comprise a disk-shaped lithium-ion battery. The light can be coupled to the handle itself, or the light may comprise a light that is mounted on a surface of the portal closure, and preferably a surface that faces inwardly toward the secured space from which unauthorized persons are locked out.

The handle may comprise one of a door handle or door knob, and the closure preferably comprises a door.

One feature of the present invention is that it includes a mechanism that is preferably movable by a non-key containing cylinder mover between two positions. The normal positions for the lock would be the locked and unlocked position, where no signal was being generated. In a typical school setting, the lock actuator would be set in the normal unlocked position so that students could pass through the door to enter the classroom. At night, the door would likely be placed in the normal locked position, for preventing unauthorized persons from entering the classroom and either stealing something from the classroom, vandalizing the classroom or otherwise using the classroom for a purpose other than that for which it is normally intended.

However, in an emergency situation, such as in the event of a shooter entering the school building or some other person being in the building that might endanger the students, the lock actuator could be placed in its emergency position. In the emergency position, the latch is locked to prevent the door from being opened to thereby prevent ingress. Additionally, the signal generator generates a signal, such as a sound signal or preferably a light signal that provides an indicia (through a speaker or lights) to those in the classroom to be secured that the door is in its locked position. Additionally, the presence of the signal generator indicates to those in the classroom that some sort of emergency exists.

From the viewpoint of the teacher or other persons supervising the secured room, the generation of the signal indicates to the teacher that the room has been properly secured, and that there is no reason to check on the door lock to ensure that it is secured. Although this acknowledgement that the door is properly secured is most likely to be comforting to the teacher when the door is locked by a student, it is also comforting to the student and teacher when the teacher is the one who actuates the lock, because the sight or sound of the signal generated by the signal generator provides confirmation to the teacher that she locked the door correctly.

Another feature of the present invention is that it includes a latch driving device mover and handle mechanism that can be retrofit into existing door systems, and latch driving devices while enabling the owner of the building to retain the then-existing and used outer door handle, aesthetic hardware, such as lock plates, latches, latch driving devices, and latch retainers. This feature has the advantage of reducing the expense that the school system or building owner would otherwise encounter when retrofitting existing locks with the lock of present invention. This cost savings can be especially advantageous, as commercial grade locks of the type that are normally used in schools can be quite expensive.

Another feature of the present invention is that optimally it includes a communications device configured for wirelessly connecting the device to a local network to enable the locking mechanism lever to send notification to a central control location to inform administrative and emergency response personnel that the emergency lock condition has been activated. This notification informs the appropriate personnel to initiate the emergency response protocol, and serves as a backup emergency alarm that will notify the authorities if the primary vehicle for doing this is rendered incapable of doing so, or has not yet sensed the threat.

Although an electronic lock variant can exist that is constructed according to the present invention, to perform functions similar to that performed by the applicant's lock, the electro-mechanical lock of the present invention is believed to enjoy a substantial cost advantage over electronic key locks.

These and other features and advantages will be apparent to those skilled in the art upon review of the drawings and detailed description presented below, which are believed by the applicant to describe the best mode of practicing the invention currently.

IV. BRIEF DESCRIPTION OF THE DRAWINGS

Figure 8A:
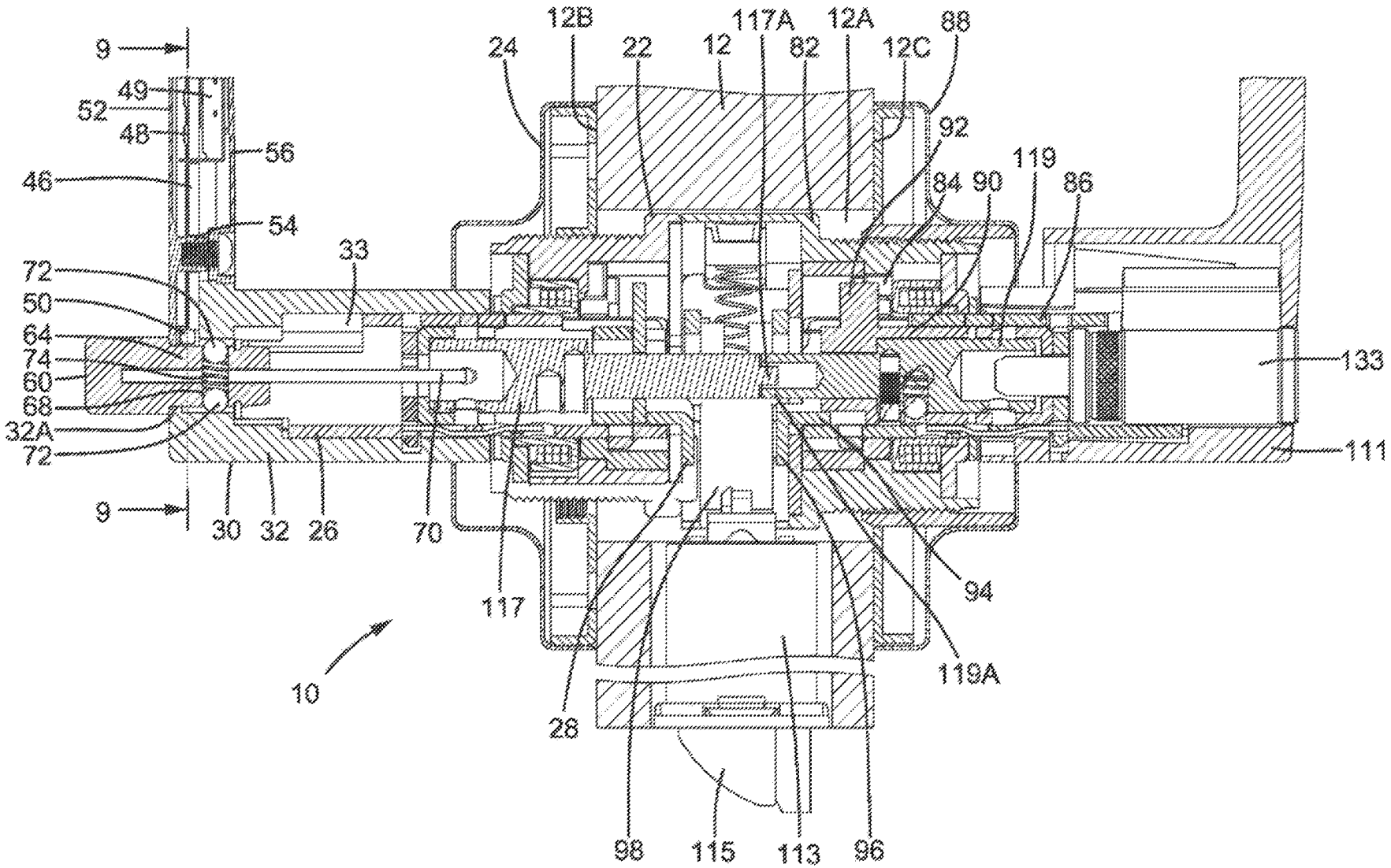
FIG. 8A is a view similar to FIG. 3, with a thumb turn pivoted to a locking
Figure 9A:
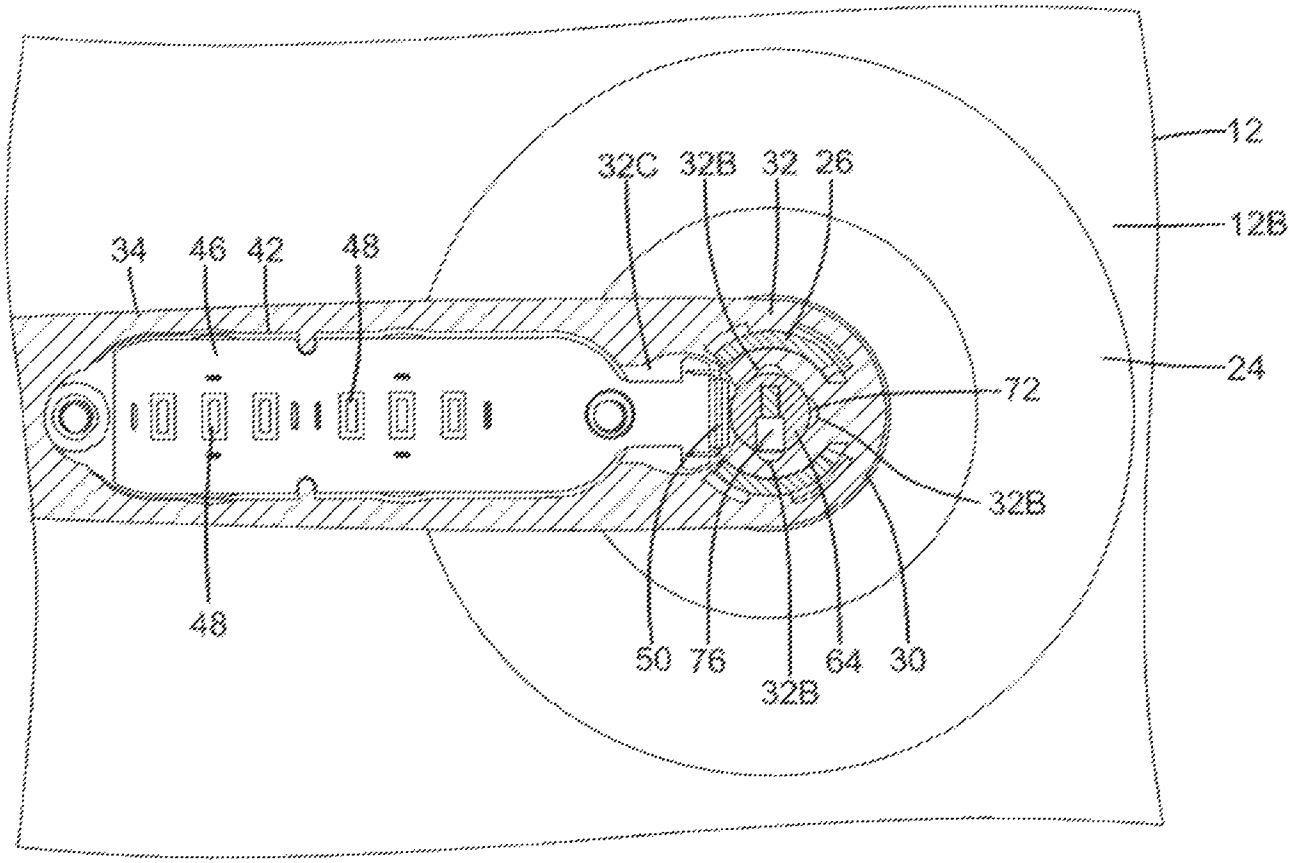
FIG. 9A is a cross sectional view taken along section line 9-9 of FIG. 8.
Figure 10:
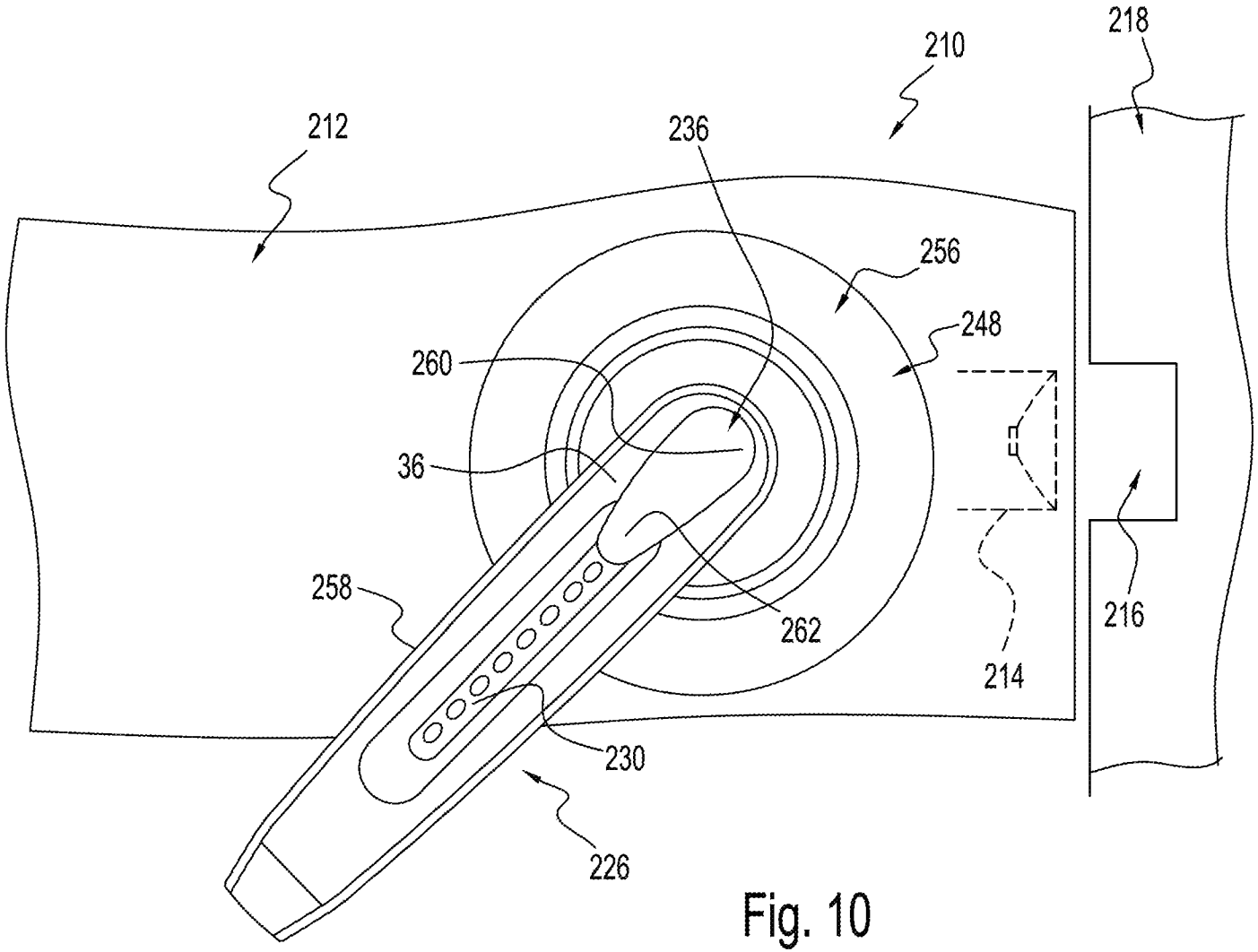

FIG. 10 et seq are of an alternate embodiment of the device shown and described with reference to FIGS. 1A-9A.

FIG. 10 is a front view of the illuminated lock mechanism of the present invention showing the lock in an first normal position.

Figure 11:
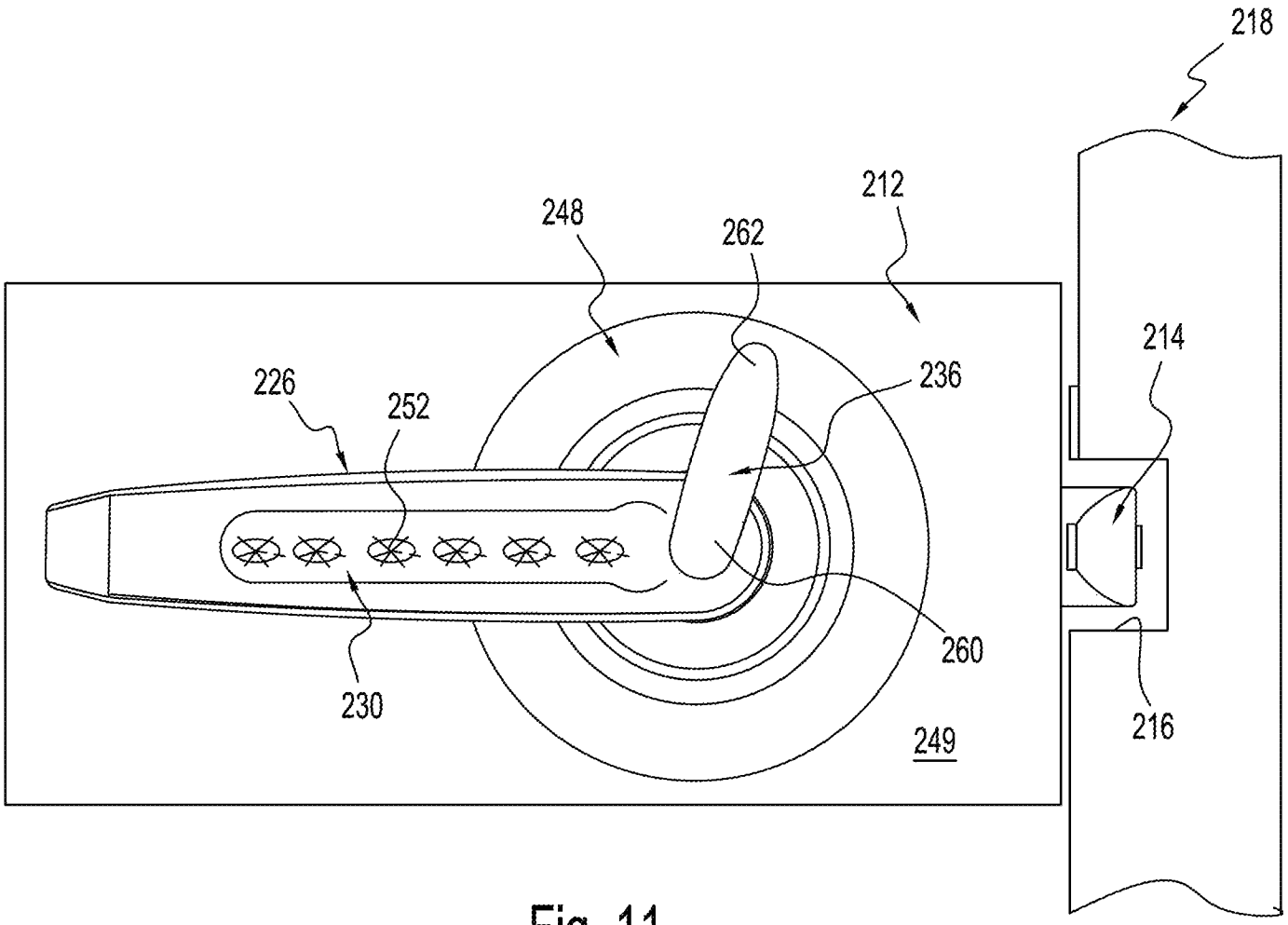

FIG. 11 is a front view of the illuminated lock mechanism of the present invention showing the lock in the second emergency position.

Figure 12:
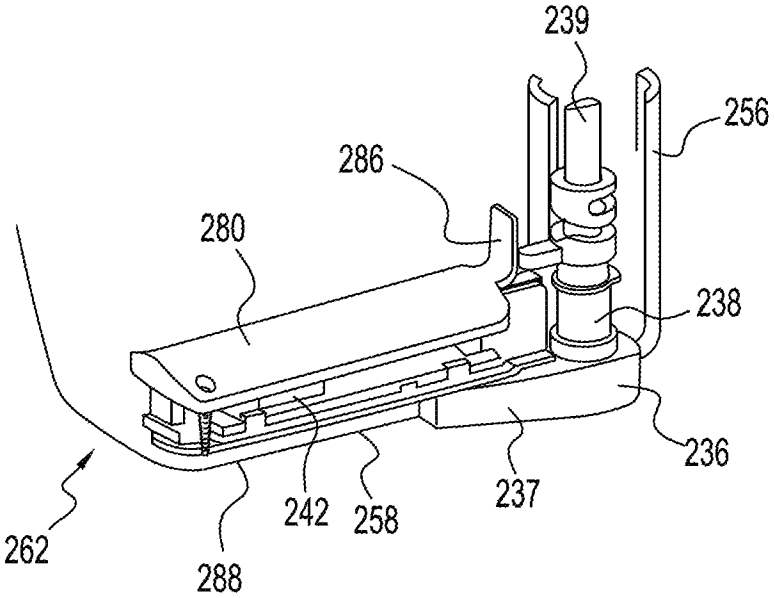

FIG. 12 is a cutaway view of the handle of the lock mechanism, showing the internal components thereof.

Figure 13:
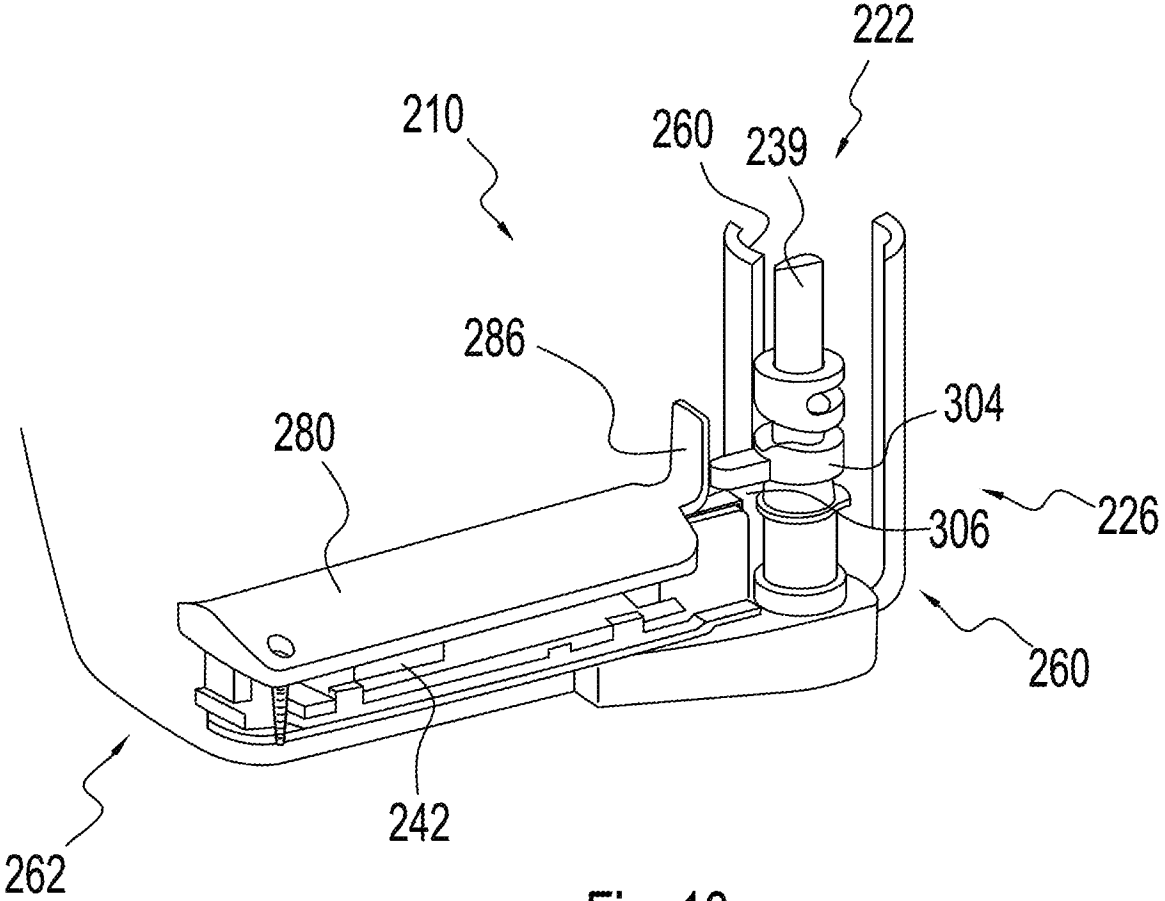

FIG. 13 is a cutaway view similar to FIG. 3, except being enlarged.

Figure 14:
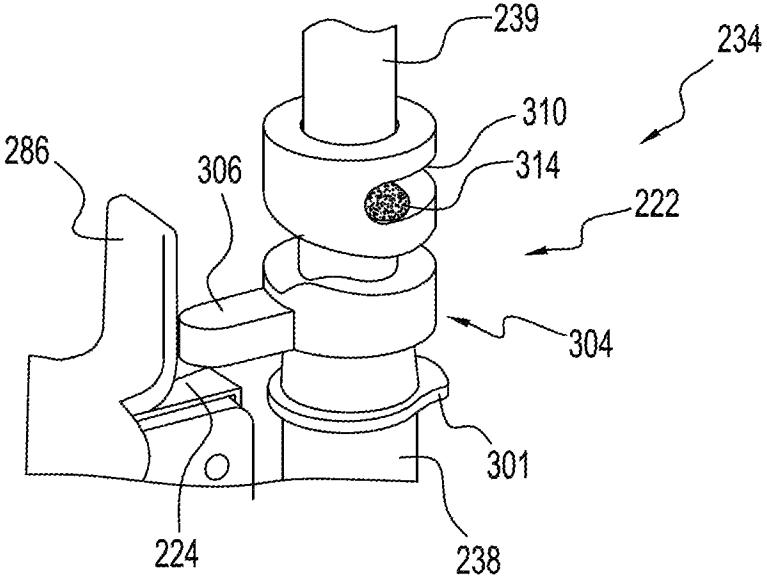

FIG. 14 is an enlarged cutaway view of the latch driving device mover portion of the lock, including the cam member containing the switch actuator and the blade member that moves the latch driving device portion of the lock and the distal end of the handle containing the fitment that engages with the latch driving device mechanism for moving the latch into and out of engagement with the latch receiver formed in the door frame.

Figure 15:
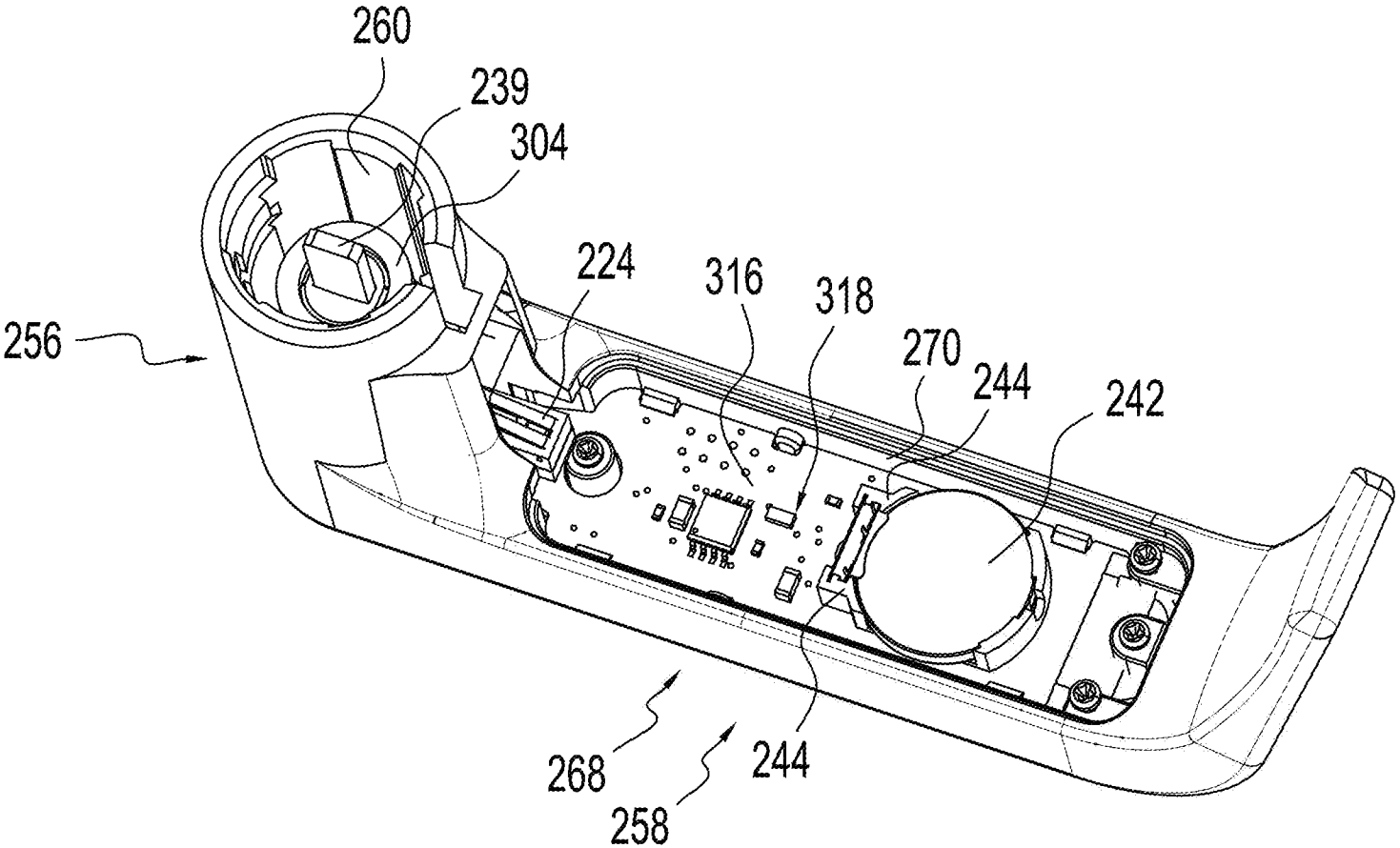

FIG. 15 is a perspective view of the interior of the illuminated lock actuator of the present invention, partially cut away to show the electronic frame or board onto which the battery, controlling circuit, and switch are coupled.

Figure 16:
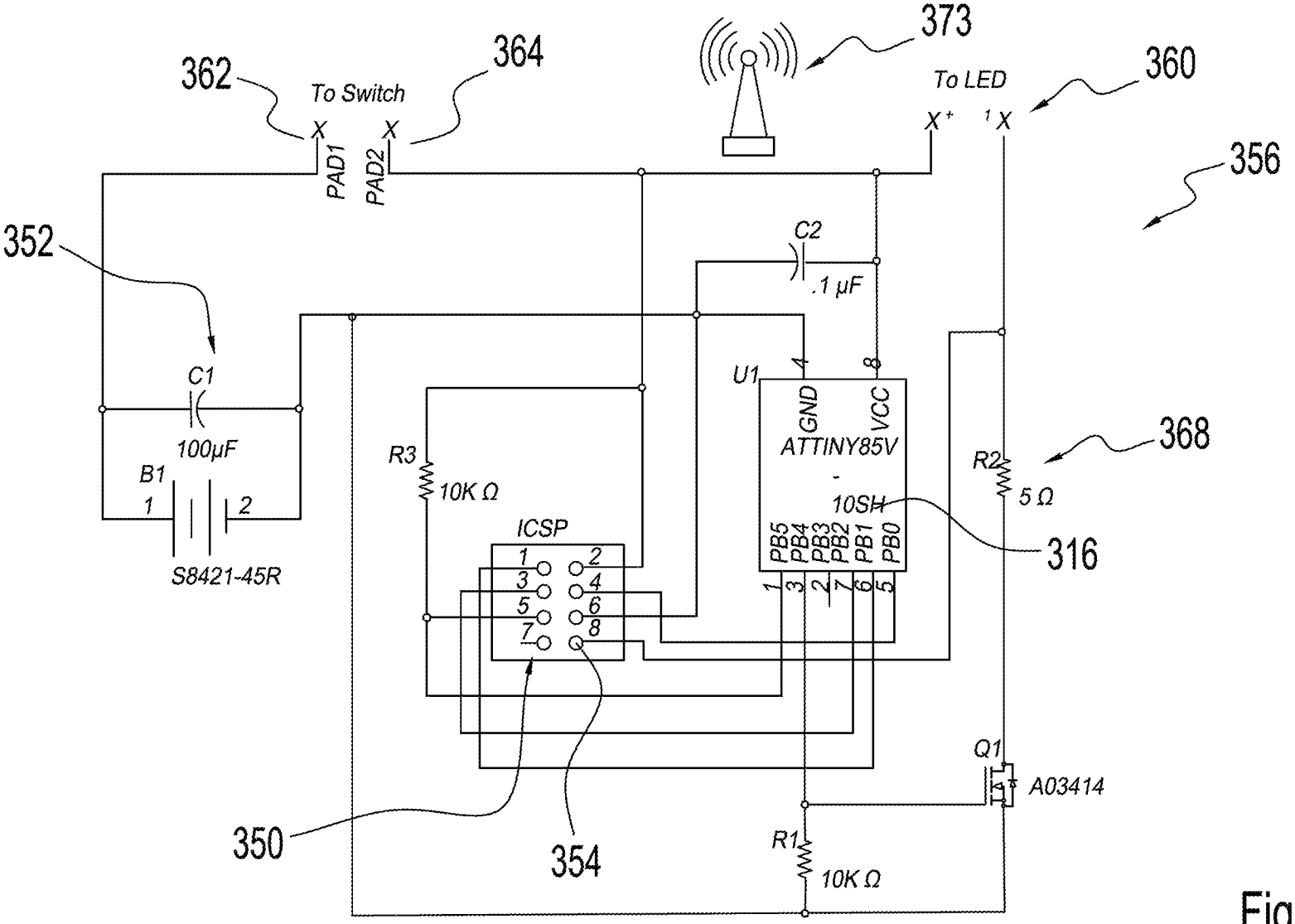

FIG. 16 is a schematic electronics diagram that schematically illustrates the electronic components of the device.

Figure 17:
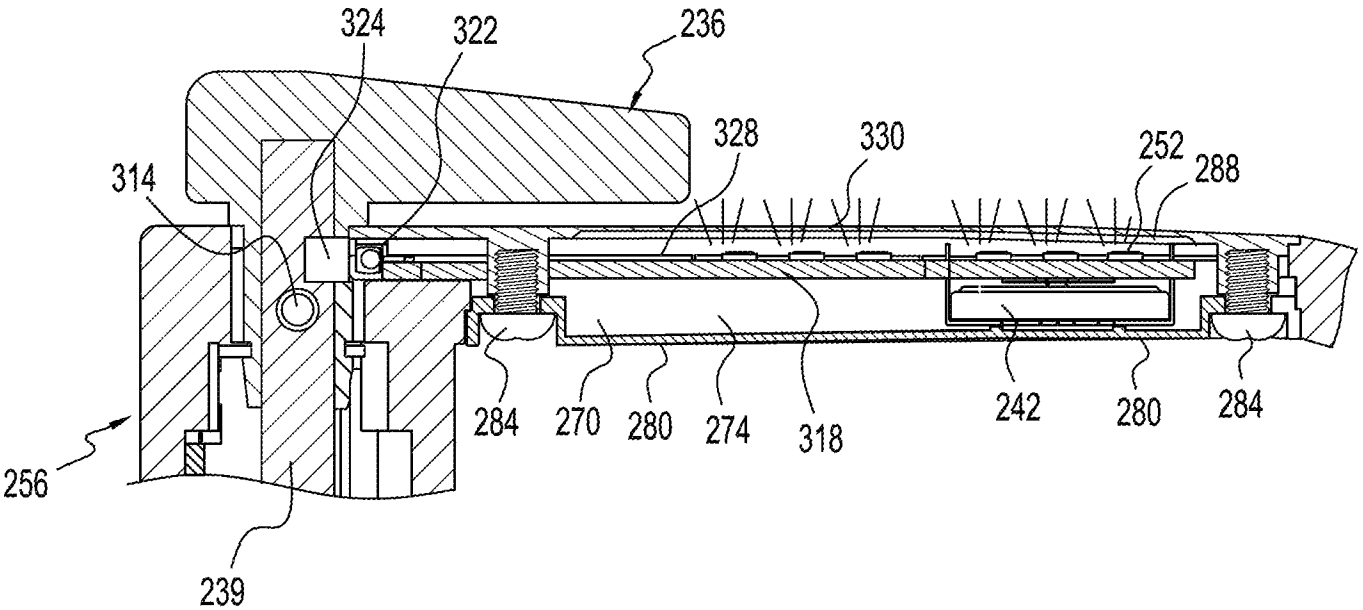

FIG. 17 is a first alternate embodiment that employs a magnetic switch rather than an electromechanical switch of the version of FIGS. 1-7.

Figure 18:
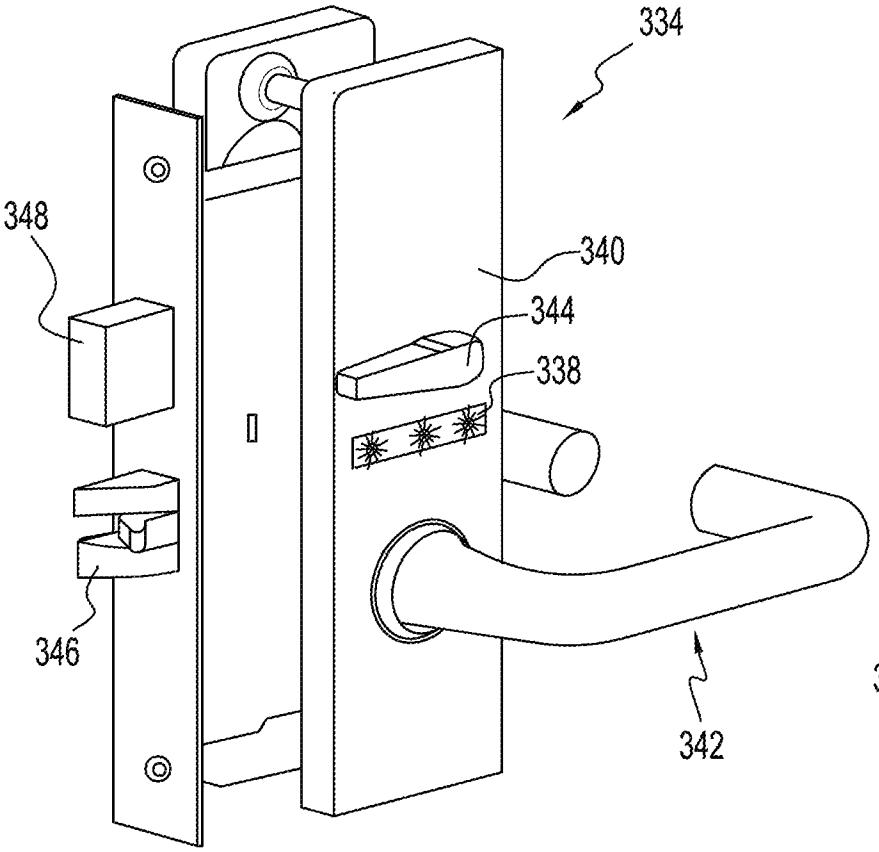

FIG. 18 is a second alternate embodiment showing the illuminated locking device of the present invention used in connection with a mortise type lock wherein the illumination is actuated to signal that the door lock is locked.

Figure 19:
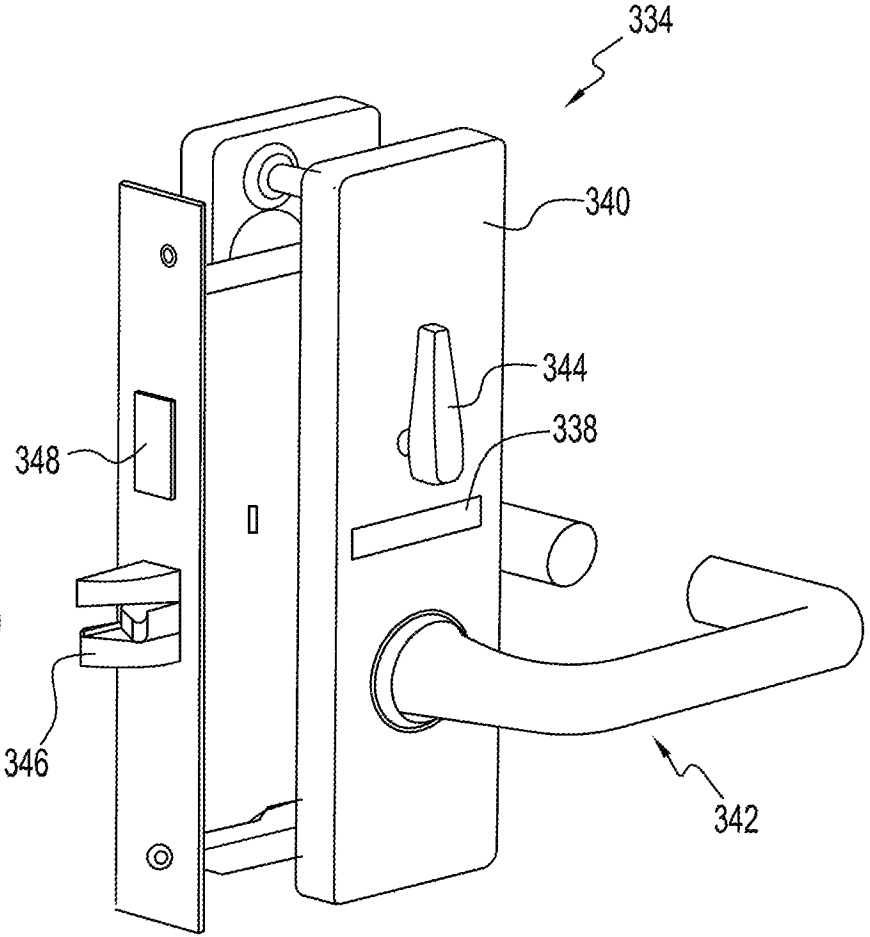
Figure 20:
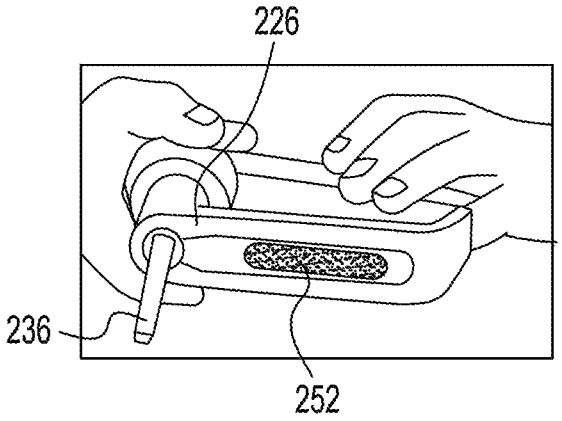
Figure 21:
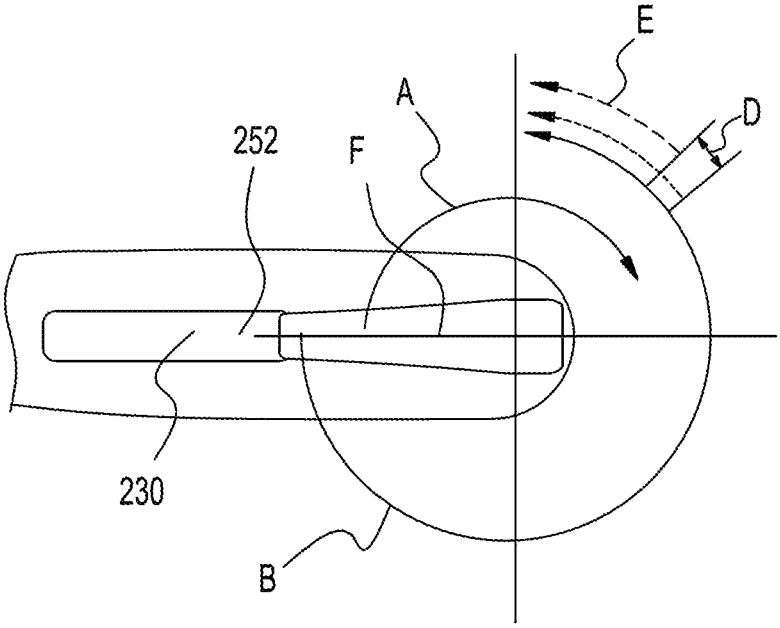
Figure 22:
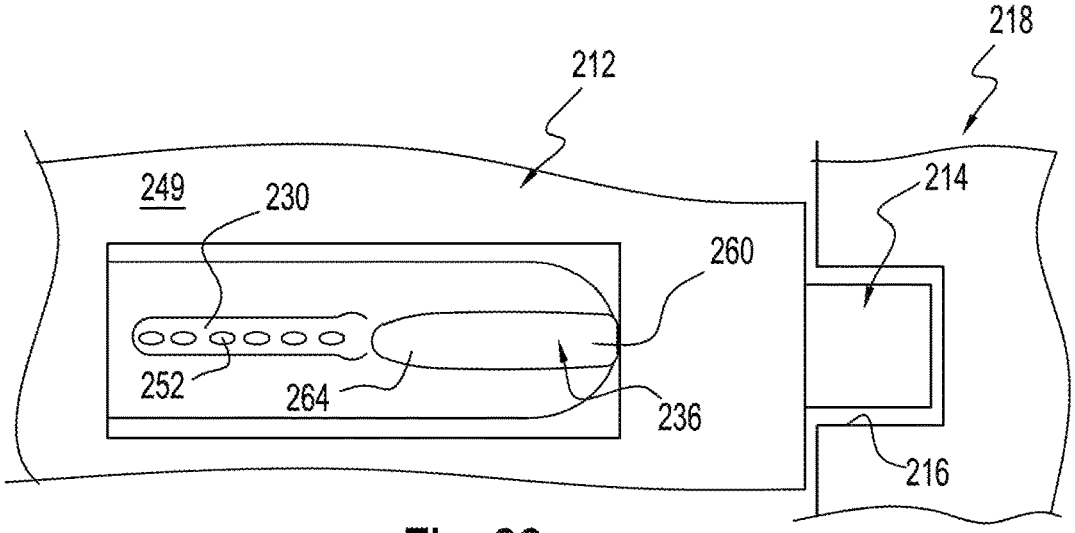
Figure 23:
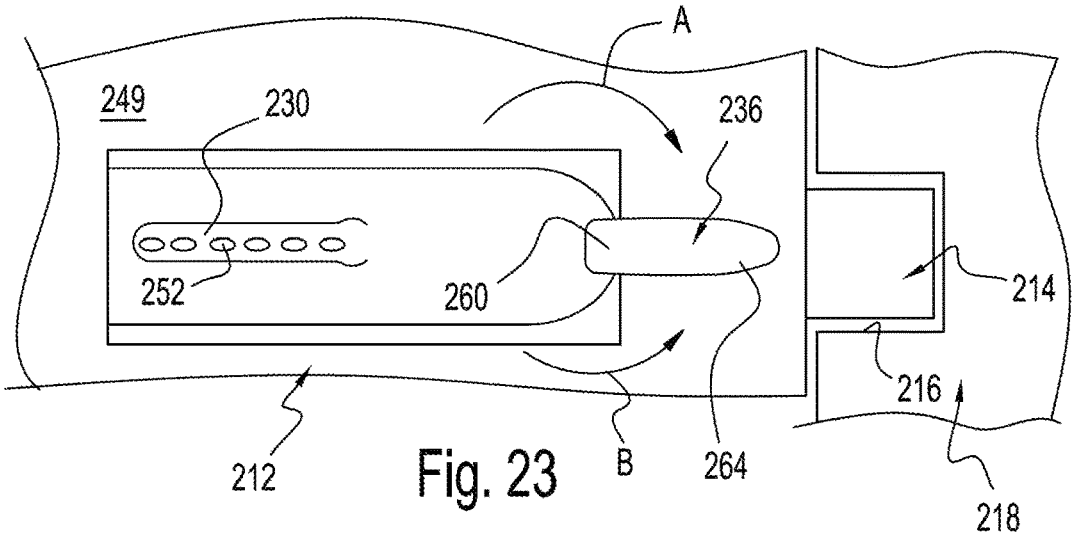
Figure 24:
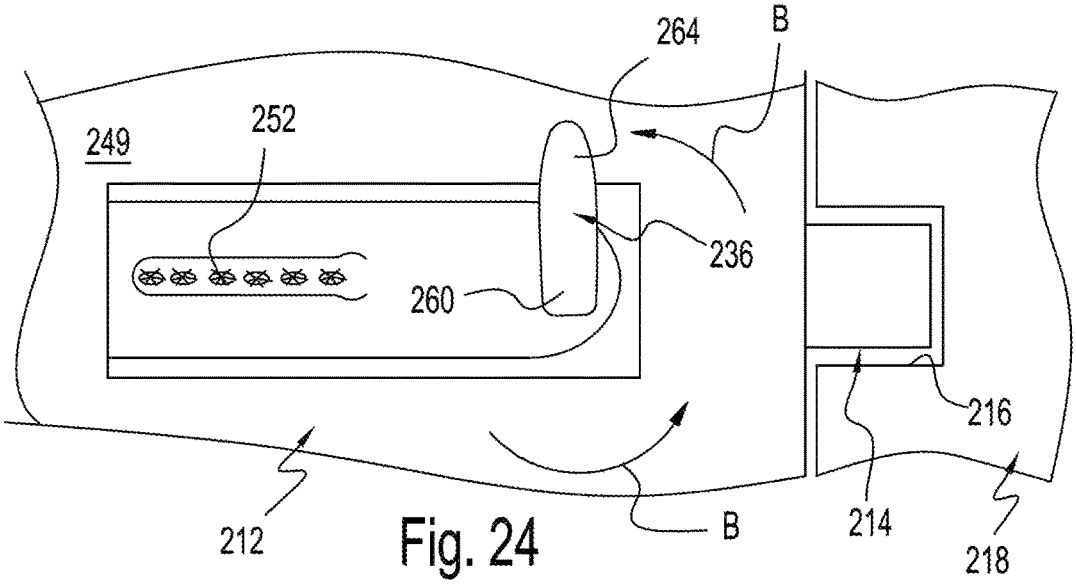

FIG. 19 is a perspective view similar to FIG. 18 except showing the lock in the "unlocked" position:

FIG. 20 is a perspective view of the prototype of the present invention showing the light bar being illuminated;

FIG. 21 is a perspective view of the lock mechanism focusing on the thumb-turnable actuator and its motion to place the door lock in a locking position, unlocking position and emergency position;

FIG. 22 is a front schematic view of the lock mechanism in the normal, non-emergency position;

FIG. 23 is a front schematic view of the lock mechanism in an intermediate position used for either unlocking the second side door handle, or locking the second side door handle prior to the lock entering the second emergency position; and FIG. 24 is a front schematic view of the lock mechanism in the locked emergency position.

All figures are drawn for ease of explanation of the basic teachings of the present invention only. The extensions of the figures with respect to number, position, relationship, and dimensions of the parts to form the embodiments will be explained or will be within the skill of the art after the following teachings of the present invention have been read and understood.

Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "inner", "outer", "side", "end", "portion", "section", "axial", "radial", "circumferential", "lateral", "horizontal", "outward", and similar terms are used herein, it should be understood that these terms have reference only to the structure shown in the drawings as it would appear to a person viewing the drawings and are utilized only to facilitate describing the invention. Unless otherwise indicated, they are not words of limitation.

V. DETAILED DESCRIPTION

A door lock 10 according to the present invention is mounted to a door 12 and can prevent the door 12 from being opened in a closed state. With reference to FIGS. 1A-3A, the door lock 10 includes a latch driving device 19 and a latch device operatively connected to the latch driving device 19. The latch driving device 19 includes an inner operating device 20 and an outer operating device 80. The inner operating device 20 includes an inner body 22 and an inner fixing member 24 threadedly coupled to an outer side of the inner body 22. A portion of the inner body 22 is received in an installation hole 12A of the door 12. The inner fixing member 24 abuts 10 an inner side 12B of the door 12. The inner operating device 20 further includes an inner spindle 26 pivotably mounted to the inner body 22 and includes an inner lug 28.

The inner operating device 20 further includes an inner handle 30 coupled to and jointly pivotable with the inner spindle 26. The inner handle 30 includes a shank 32 and a lever 34 extending from an end of the shank 32. The shank 32 includes a pivotal hole 32A extending from an end face of the shank 32 towards but spaced from another end face of the shank 32. The shank 32 further includes a coupling hole 33 extending from the other end face of the shank 32 to the pivotal hole 32A.

The inner handle 30 further includes four positioning groove 32B in an inner periphery of the pivotal hole 32A and spaced from each other by 90° about a pivotal axis defined by the shank 32. The lever 34 includes an inner surface 36 and an outer surface 38 spaced from the inner surface 36. The lever 34 further includes an outer groove 42 extending from the outer surface 38 towards but spaced from the inner surface 36.

The lever 34 further includes an inner groove 45 extending from the inner surface 36 towards but spaced from the outer surface 38. The lever 34 further includes a chamber 44, 25 extending between the inner groove 42 and the outer groove 45. The inner handle 30 further includes a through-hole 32C extending between the chamber 44 and the pivotal hole 32A. The coupling hole 33 of the shank 32 of the inner handle 30 couples with the inner spindle 26. Thus, the inner spindle 26 pivots when a user grips and pivots the lever 34 of the inner handle 30.

Figure 1A:
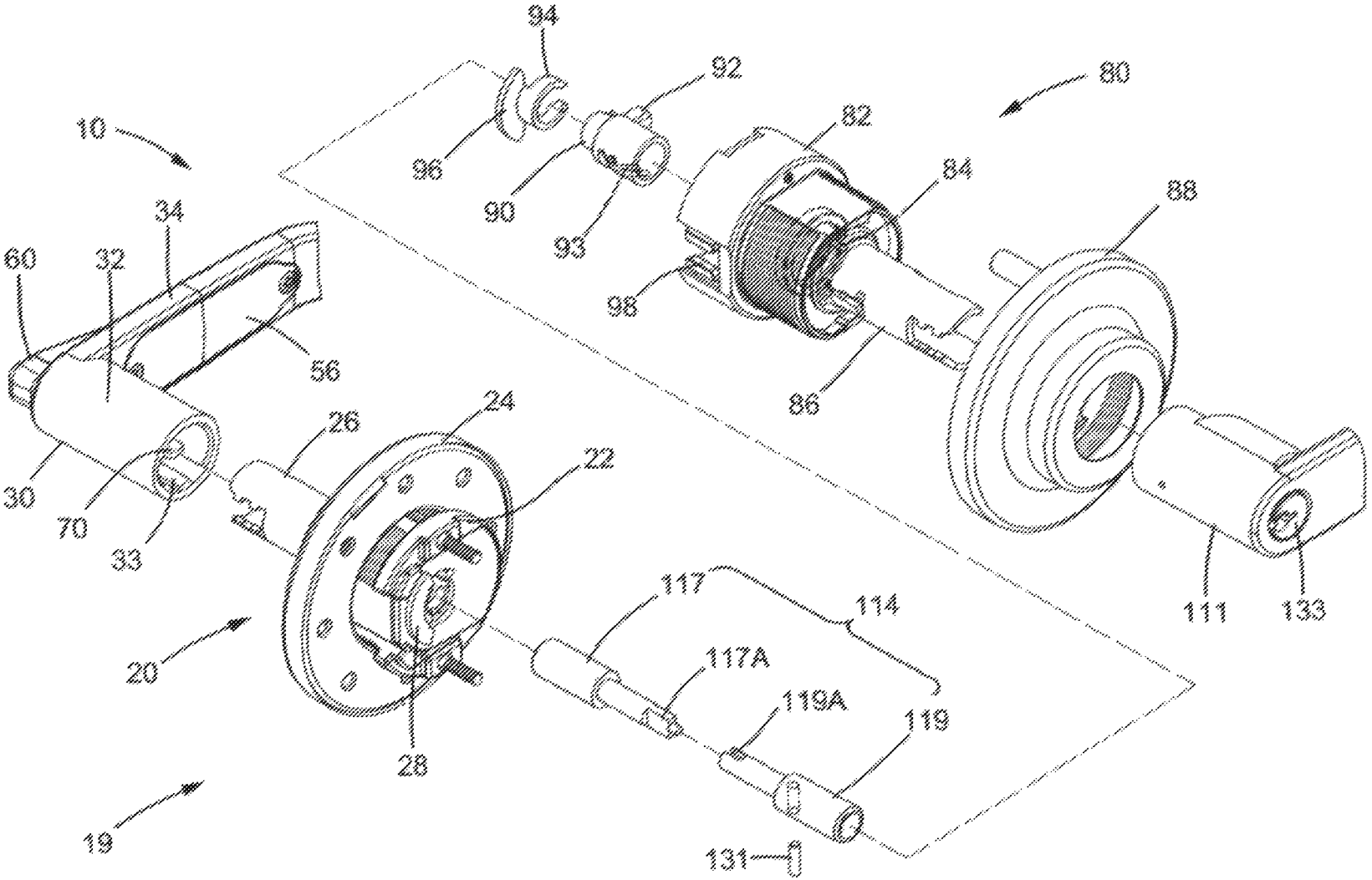
FIG. 1A is an exploded, perspective view of a door lock of an embodiment according to the present invention.
Figure 2A:
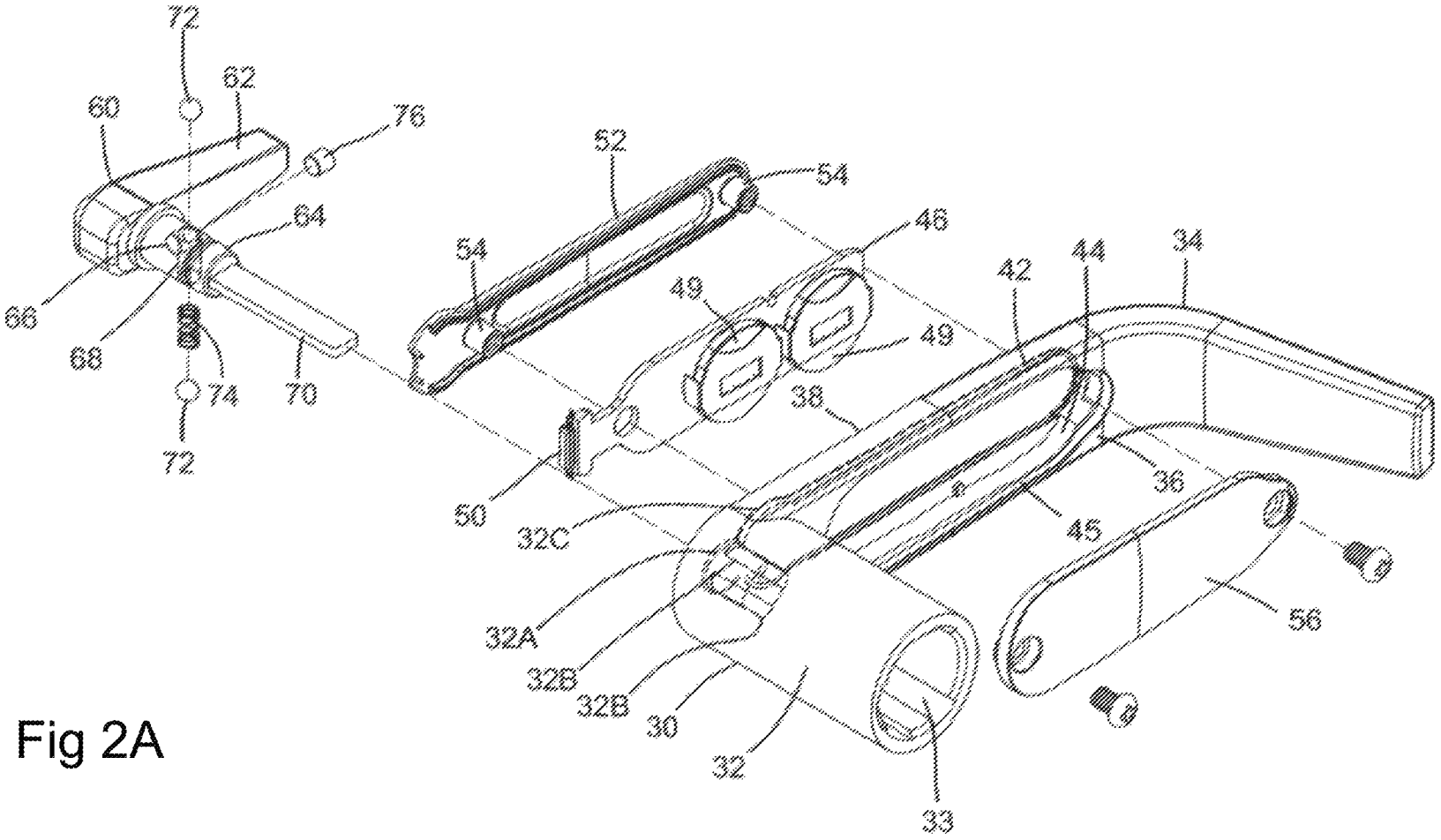
FIG. 2A is a partially exploded perspective view of the door lock of the embodiment according to the present invention.
Figure 3A:
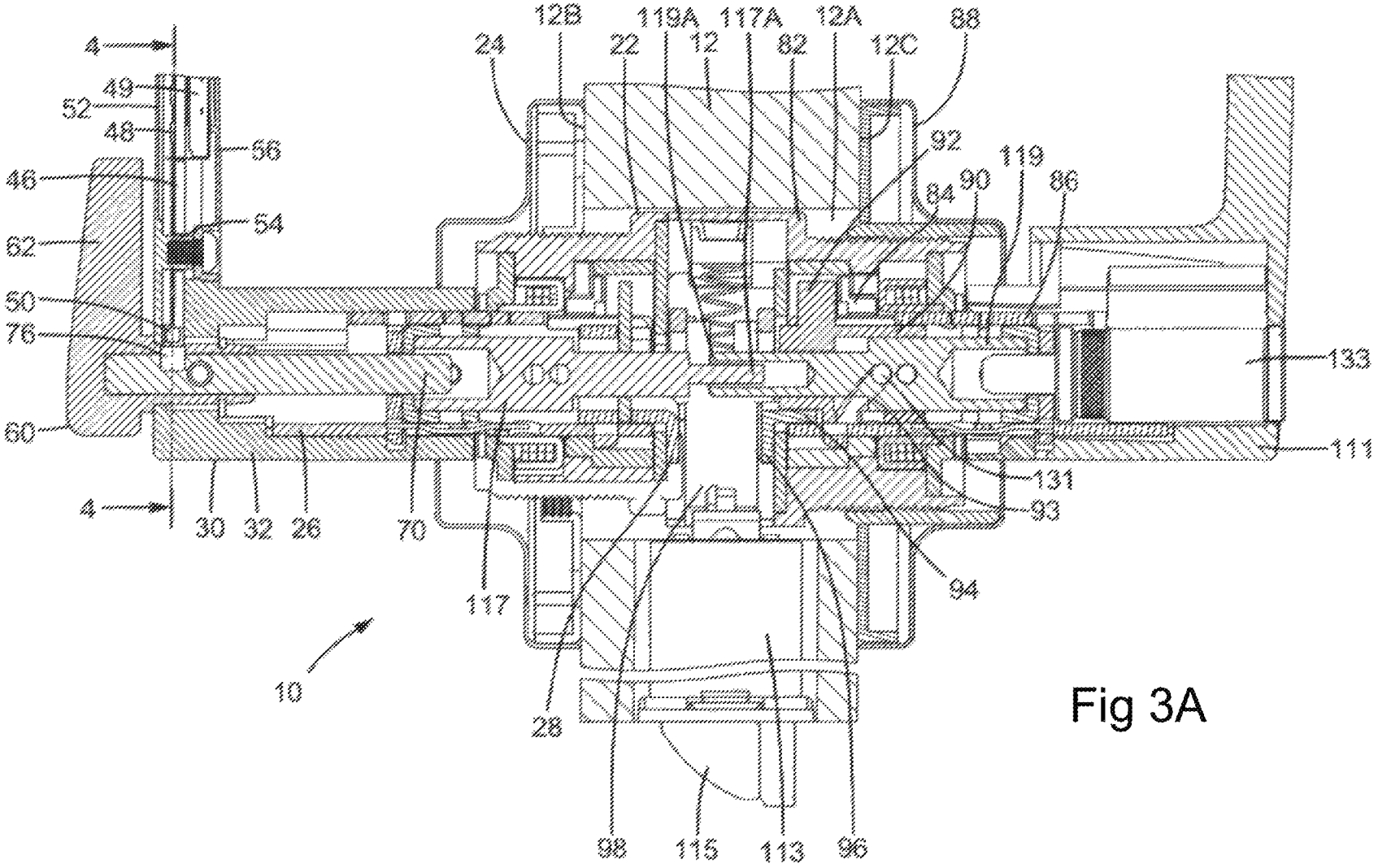
FIG. 3A is a cross sectional view of the door lock of the embodiment according to the present invention.

The inner operating device 20 further includes a thumb turn 60 pivotably connected to the inner handle 30. The thumb turn 60 includes a stem 62 and a pivotal portion 64 extending from a side of the stem 62. The thumb turn 60 further includes a driving end 70 extending from an end face of the pivotal portion 64. With reference to FIGS. 2A, 3A and 8A, the thumb turn 60 further includes a receptacle 66 extending in a radial direction and a receiving hole 68 spaced from the receptacle 66. An actuator 76 in the form of a permanent magnet is securely received in the receptacle 66. Two positioning members 72 in the form of balls are received in the receiving hole 68. A biasing spring 74 is mounted between the two positioning members 72 and bias the two positioning members 72 outward.

The pivotal portion 64 of the thumb turn 60 is pivotably coupled with the pivotal hole 32A of the inner handle 30. The driving end 70 is located in the inner spindle 26 (FIG. 3A). The two positioning members 72 are retained by the inner periphery of the coupling hole 32A and, thus, cannot move out of the receiving hole 68. Furthermore, the biasing spring 74 bias the two-positioning member 72 to press against the inner periphery of the pivotal hole 32A.

Figure 4A:
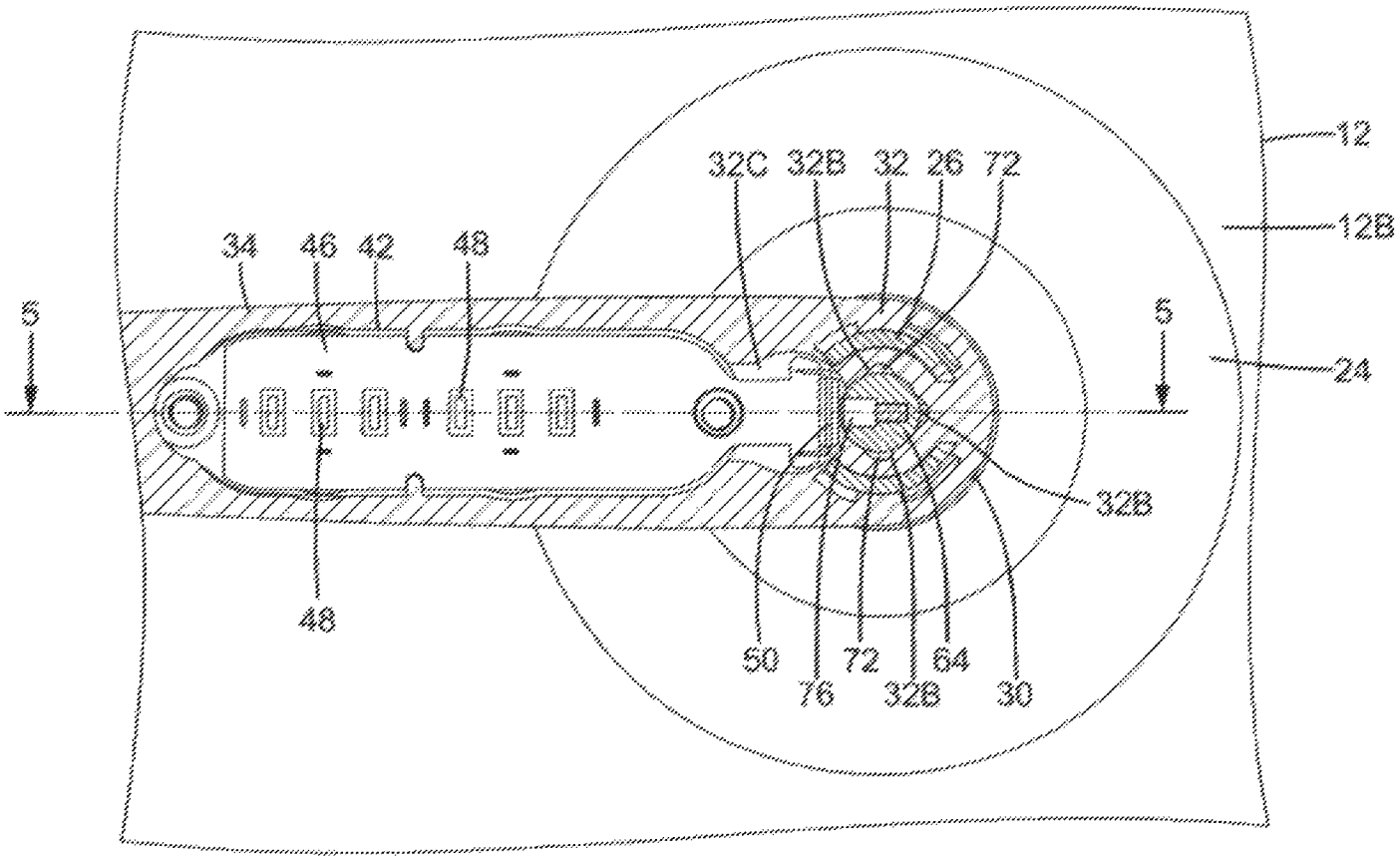
FIG. 4A is a cross sectional view taken along section line 4-4 of FIG. 3.

The thumb turn 60 is pivotable between a locking position (FIG. 8A) and an unlocking position (FIG. 3A) about the pivotal axis defined by the pivotal hole 32A. When the thumb turn 60 is in the locking position, the two positioning members 72 engage with two of the four positioning grooves 32B, and the actuator 76 is aligned with the through-hole 32C (FIG. 4A). When the thumb turn 60 is in the unlocking position, the two positioning members 72 engage with the other two of the four positioning grooves 32B, and the actuator 76 is misaligned from the through-hole 32C (FIG. 9A).

A lighting device 46, a first lid 52, and a second lid 56 are mounted to the lever 34. The lighting device 46 includes a plurality of lighting elements 48 in the form of light emitting diodes (LEDs) and two batteries 49 powering the plurality of lighting elements 48. A switch 50 is mounted between the plurality of lighting element 48 and the two batteries 49 and can be in the form of a reed switch for cooperating with the actuator 76 in the form of a permanent magnet.

The switch 50 can be in a conductive state in which the two batteries 49 supply electricity to the plurality of lighting elements 48 or a non-conductive state in which the two batteries 49 do not supply electricity to the plurality of lighting elements 48. When the thumb turn 60 is in the locking position, the actuator 76 is spaced from the switch 50 in a circumferential direction of the pivotal hole 32A, the switch 60 is set to the conductive state (FIG. 9A), and the plurality of lighting elements 48 generates light. When the thumb turn 60 is in the unlocking position, the actuator 76 is aligned with the switch 50, the switch 60 is set to the non-conductive state (FIG. 4A), and the plurality of lighting elements 48 does not generate light.

Figure 5A:
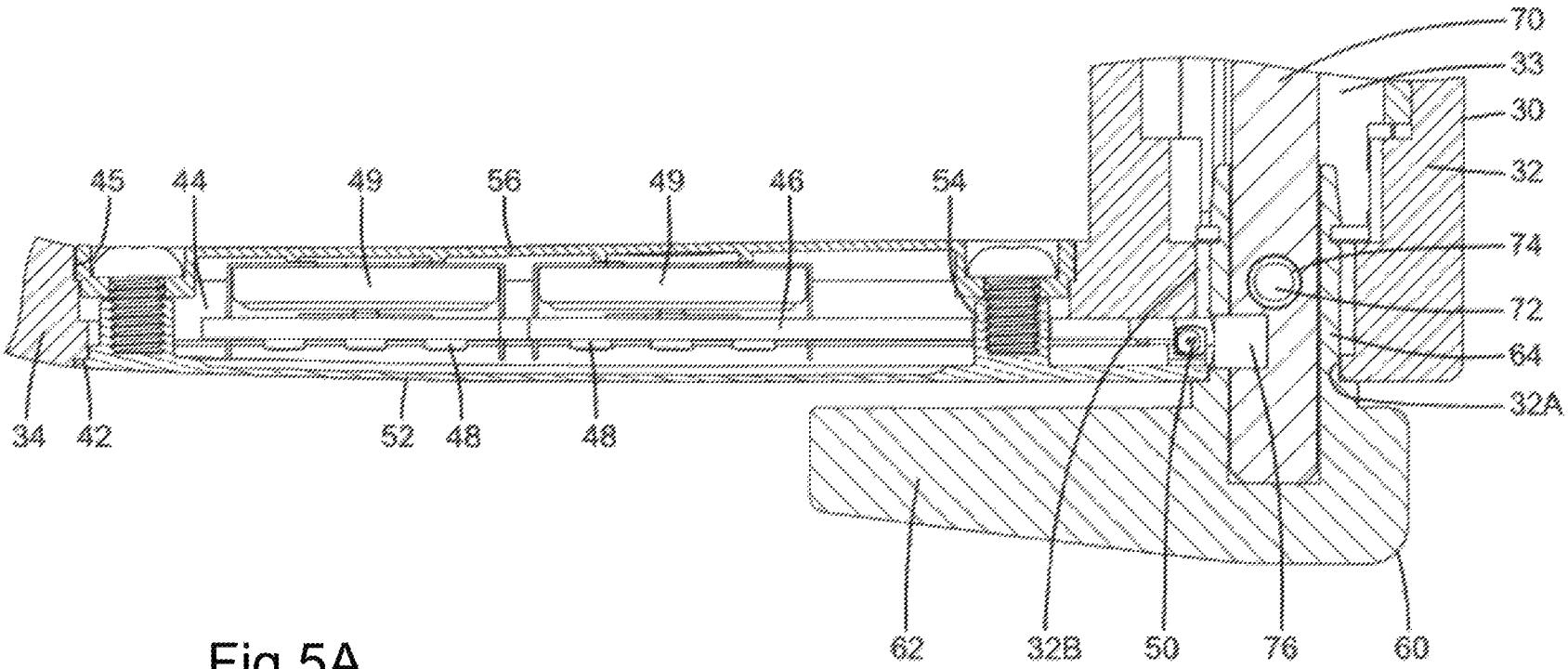
FIG. 5A is a cross sectional view taken along section line 5-5 of FIG. 4.
Figure 6A:
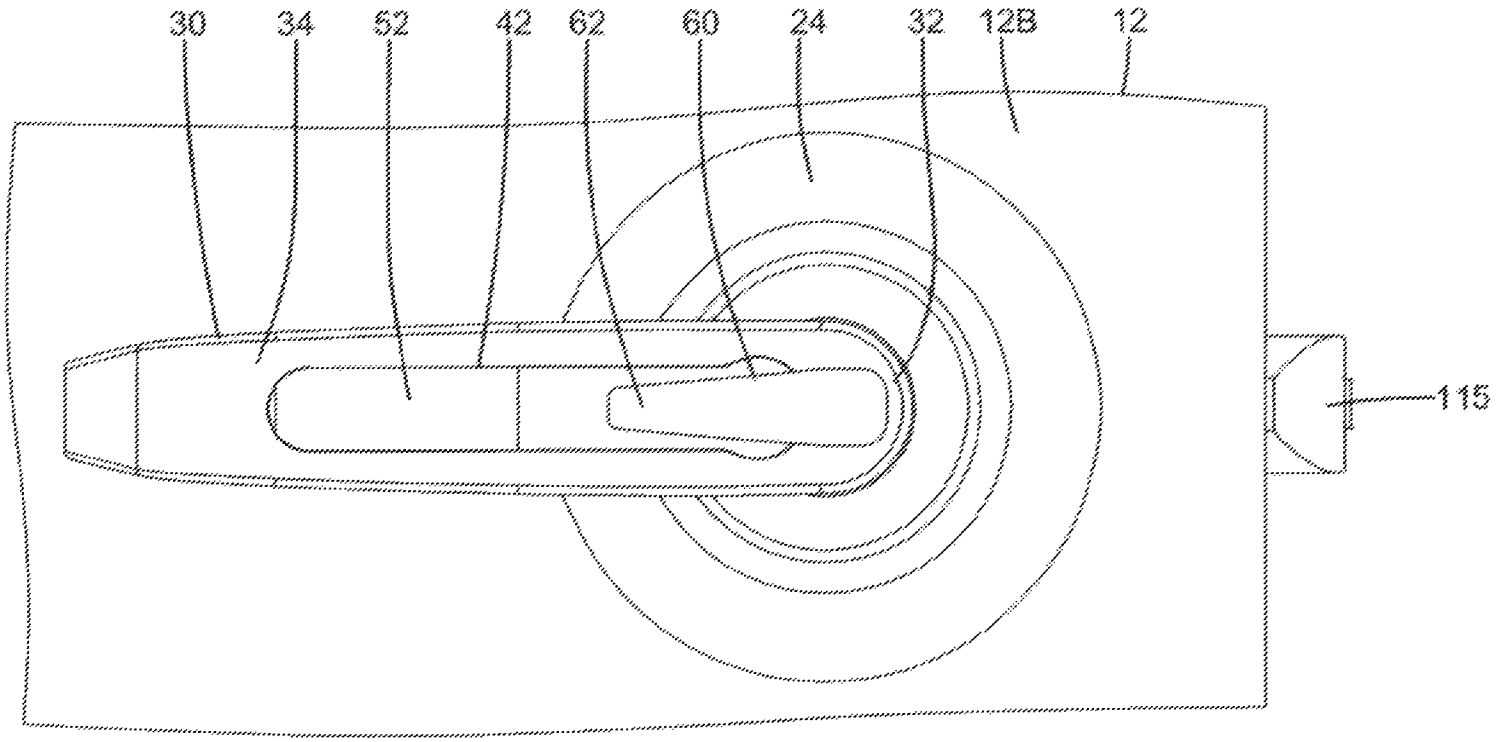
FIG. 6A is a diagrammatic side view illustrating an inner handle of the door lock in a horizontal position

The first lid 52 is made of light-transmittable material and includes two engaging portions 54 on an inner side thereof. The first lid 52 is received in the outer groove 42 of the lever 34. The two engaging portions 54 extend through the lighting device 46. The second lid 56 is received in the inner groove 45 of the lever 34. The distal ends of the two engaging portions 54 abut an inner side of the second lid 56. Two fasteners 58 extend through the second lid 56 and threadedly engage with the two engaging portions 54, respectively. Thus, the lighting device 46 is securely fixed in the chamber 44 (FIG. 5A).

The outer operating device 80 includes an outer body 82 coupled with the installation hole 12A of the door 12 and an outer fixing member 88 threadedly mounted to an outer side of the outer body 82. The outer body 82 includes a limiting groove 84 (FIG. 3A). The outer fixing member 88 abuts the outer side 12C of the door 12 and threadedly engages with the inner fixing member 24. Thus, the inner body 22 and the outer body 82 are non-rotatably coupled to the door 12 by the inner fixing member 24 and the outer fixing member 88.

The outer operating device 80 further includes an outer spindle 86 pivotably connected to the outer body 82. The outer operating device 80 further includes a locking member 90 and a driving member 94 which are mounted in the outer body 82 and which interlock with the outer spindle 86. The locking member 90 includes a limiting block 92 on an outer periphery thereof and a guiding groove 93 extending helically on the outer periphery. The locking member 90 is movable in an axial direction of the outer spindle 86 between a locking position (FIG. 8A) in which the limiting block 92 engage with the limiting groove 84 of the body 82 and a non-locking position (FIG. 3A) in which the limiting block 92 disengages from the limiting groove 84 of the body 82. The driving member 94 includes an outer lug 96.

The outer spindle 86 interlocks with an outer handle 111 receiving a lock core 133. The outer body 82 is coupled with the inner body 22. A retractor 98 is mounted between the inner body 22 and the outer body 82 and is movable in a transverse direction perpendicular to the axial direction of the outer spindle 86.

The latch driving device 19 further includes a connecting shaft 114 between the inner operating device 20 and the outer operating device 80. The inner lug 28 and the outer lug 96 interlock with the retractor 98. The connecting shaft 114 includes an inner shaft portion 117 pivotably received in the inner spindle 26 and an outer shaft portion 119 pivotably received in the locking member 90, as shown in FIG. 3A. The inner shaft portion 117 includes a coupling end 117A having non-circular cross sections.

The outer shaft portion 119 includes a connecting end 119A matched with the coupling end 117A. The coupling end 117A of the inner shaft portion 117 interlocks with the connecting end 119A of the outer shaft portion 119. Thus, when the inner shaft portion 117 pivots, the outer shaft portion 119 pivots synchronously while permitting the outer shaft portion 119 to move relative to the inner shaft portion 117 in the axial direction of the outer spindle 86.

An interlocking member 131 is securely mounted on the outer shaft portion 119 and includes a distal end extending into the guiding groove 93 of the locking member 90. When the outer shaft portion 119 pivots, the interlocking member 131 pushes the locking member 90 to move in the axial direction of the outer spindle 86 between the locking position (FIG. 8A) and the non-locking position (FIG. 3A). Furthermore, the lock core 133 interlocks with the outer shaft portion 119, such that a key can be used to rotate the outer shaft portion 119.

Figure 7A:
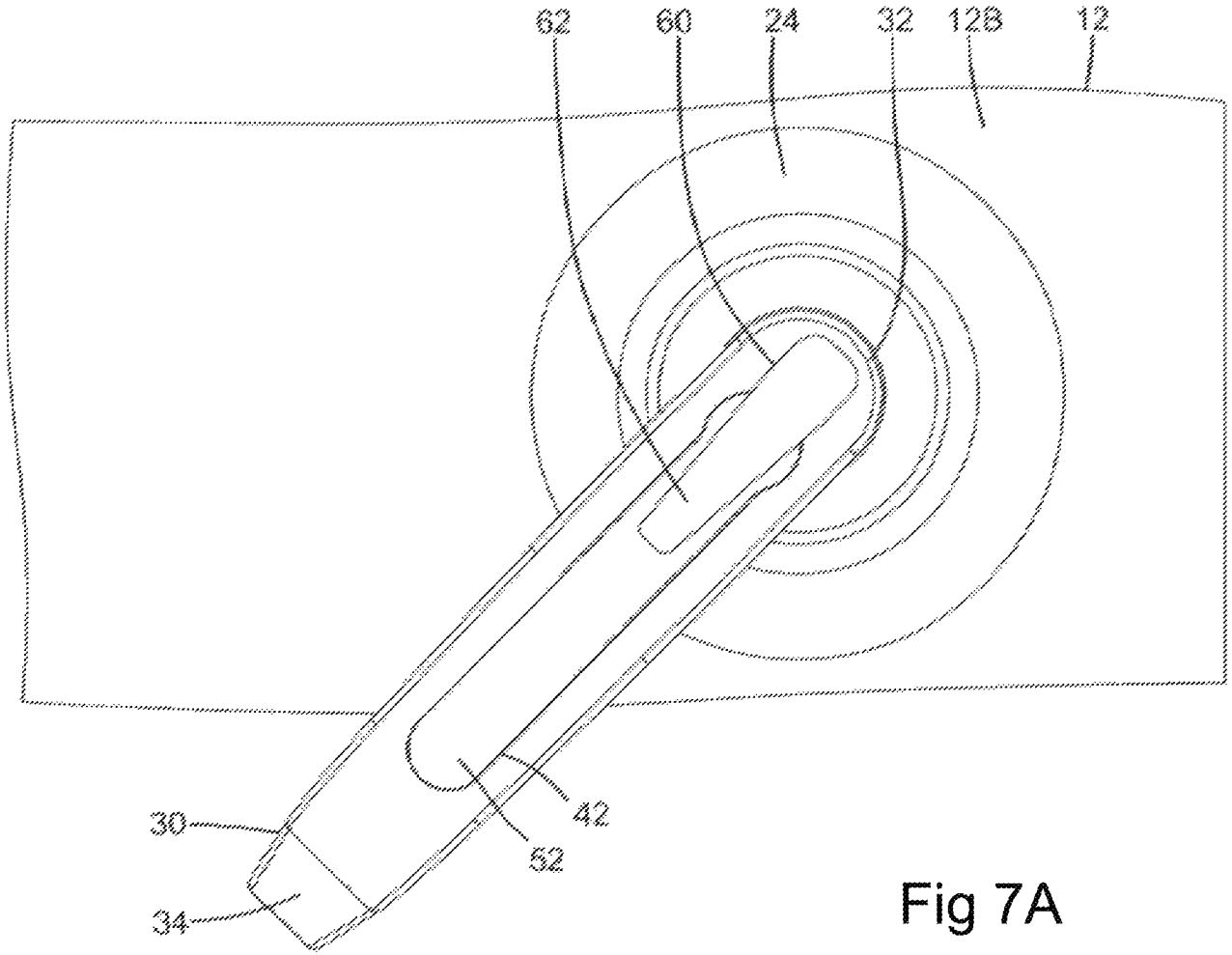
FIG. 7A is a diagrammatic side view illustrating the inner handle pivoted to an unlatching position.

The latching device 113 is securely mounted to the door 12 and interlocks with the retractor 98 of the latch driving device 19. The latching device 113 includes a latch 115 movable between an extended, latching position (FIG. 6A) and a retracted, unlatching position (FIG. 7A). The outer handle 111 or the inner handle 30 can be pivoted to move the latch 115 from the latching position to the unlatching position.

With reference to FIGS. 3A-6A, for the sake of explanation, it will be assumed that the door 12 is in the closed state, the latch 115 is in the latching position, the thumb turn 60 is in the unlatching position, and the actuator 76 is aligned with the switch 50 (FIG. 4A), such that the switch 50 is set to be non-conductive. The plurality of lighting elements 48 does not generate light. A person at the inner side of the door 12 can be visually aware of this situation and, thus, can identify that the door 10 is set to the locking state. In this state, the limiting block 92 of the locking member 90 is spaced from the limiting groove 84 in the axial direction of the outer spindle 86, permitting the latch 115 to move to the unlatching position by operating the inner handle 30 or the outer handle 111.

Specifically, when the inner handle 30 is turned, the inner spindle 26 pivots to displace the retractor 98 by the inner lug 28, which, in turn, moves the latch 115 from the latching position to the unlatching position through the latching device 113. When the outer handle 111 is turned, the outer spindle 86 pivots to actuate the locking member 90 and the driving member 94 to pivot. Furthermore, the outer lug 96 of the driving member 94 displaces the retractor 98 to move the latch 115 from the latching position to the unlatching position.

When the thumb turn 60 pivots from the unlocking position to the locking position while the door 12 is closed, the actuator 76 is spaced from the switch 50 about the pivot axis defined by the pivotal hole 32A. The switch 50 is set to the conductive state, such that the two batteries 49 supply electricity to the plurality of lighting elements 48 to generate light transmitting through the first lid 52. Thus, the person at the inner side of the door 12 can see the first lid 52 is illuminated to thereby identify that the door lock 10 is set to the locking state.

Furthermore, when the thumb turn 60 pivots to the locking position, the connecting shaft 114 pivots together, and the interlocking member 131 moves the locking member 90 in the axial direction of the outer spindle 86 to the locking position, such that the limiting block 92 is located in the limiting groove 84 of the outer body 82, limiting pivotal movement of the limiting block 92. As a result, the driving member 94, the outer spindle 86, and the outer handle 111 cannot pivot. Namely, the door lock 10 is set to the locking state, and the latch 115 cannot move to the latching position by operating the outer handle 111.

Note that when the door lock 10 is set to the locking state, since the inner spindle 26 can pivot relative to the inner shaft portion 117 of the connecting shaft 114 the inner handle 30 can be operated to move the latch 115 to the latching position.

The lock core 133 of the door lock 10 can be set to the locking state or unlocking state. Specifically, since the lock core 133 interlocks with the outer shaft portion 119 of the connecting shaft 114, when a key is used to rotate the lock core 133, the outer shaft portion 119 pivots together with the lock core 133, moving the locking member 90 to the locking position or the unlocking position, thereby setting the door lock 10 to the locking or unlocking state. Furthermore, when the lock core 133 pivots together with the outer shaft portion 119, the inner shaft portion 117 pivots synchronously with the outer shaft portion 119. Furthermore, the inner shaft portion 117 actuates the thumb turn 60 to pivot to the locking position or the unlocking position. Thus, when the lock core 133 is used to set the door lock 10 to the locking state, the plurality of lighting elements 48 still generates light to illuminate the first lid 52.

Accordingly, the thumb turn 60 is used to control lighting of the plurality of lighting elements 48, such that the user can easily identify whether the door lock 10 is in the locking or unlocking state by sight, providing use convenience.

The locking or unlocking state of the door lock 10 can be identified by visually checking whether the first lid 52 is illuminated. In the case of safety control (such as a gunshot event) in a school or the like, students in a classroom can see the illuminated lid 52 to thereby know that the door 12 is locked and therefore cannot be opened easily by a threatening person outside of the classroom.

The connecting shaft 114 cooperates with the locking member 90 to permit the user to set the door lock 10 to the locking or unlocking state by using the thumb turn 60 or the lock core 133. In either case, the plurality of lighting elements 48 generate light.

Now that the basic teachings of the present invention have been explained, many extensions and variations will be obvious to one having ordinary skill in the art. For example, the switch 50 can be of a type other than the reed switch, such as a proximity switch. The actuator 76 can be a protrusion on an outer periphery of the pivotal portion 64 of the thumb turn 60. The protrusion presses against the proximity switch to control conduction of the switch 50 and to control lighting of the plurality of lighting elements 48. Furthermore, the lighting device 46 can include only one lighting element 48. Furthermore, the door lock 10 can include only one positioning member 72, and the inner handle 30 can include only two positioning grooves 32B.

An alternate set of embodiments are shown in FIGS. 10-24.

A locking mechanism 210 is provided for use with a portal closure 212, such as a door. The locking mechanism 210 is designed for use with many of the components shown in FIG. 1A such as the latch driving device 19, and a second side latch driving device mover 111, such as outer handle 111 which includes a keyed lock cylinder 133

The locking mechanism 210 includes a latch 214 that is movable into and out of engagement with a latch receiver 216, that is typically formed by a latch plate that is coupled to a non-moving structure, such as a door frame 218, or a wall (not shown). Latch 214 is preferably a spring biased latch that is normally biased into the extended position.

The locking mechanism 210 includes a latch driving device 19 (FIG. 1A) that is coupled to the latch 214, and is rotatably movable for moving the latch 214 into and out of engagement with the latch receiver 216. A user-manipulatable first side handle 226 is coupled to the latch driving device 19 for enabling the user to move the latch driving device 19, such as by pivoting the handle 226 to rotate the latch driving device 19 from the first side of the door which here faces the room to be secured. The handle 226 includes a shank portion 256 that is coupled to the latch driving device 19, and a lever portion 258 that is configured for gripping by the user. Although a handle 226 is shown, other types of door lock user manipulation devices, such as knobs and bars, will also serve the intended purpose well.

In some arrangements, there may exist no handle 226 or knob, but rather the user manipulatable device may comprise a key that is insertable into an axially extending key slot that extends axially though the center of the latch driving device 19 that is similar to cylinder 133. Although such keys will perform their intended function of manipulating the latch driving device 19 and door lock 210 of the present invention in a workman-like manner, it is believed that the use of a knob or handle 226 has advantages over the user of a key cylinder. Nonetheless, a key cylinder 133 may be used on the exterior surface of the door 212, and often will be so used.

Further, there are times when a handle 226 may not be employed. One such example is when the locking mechanism 210 of the present invention is retrofit onto a deadbolt type lock that is separate from the handle 226. Such deadbolt type locks typically have a lock latch driving device 19 and latch driving device mover. On the exterior surface, a key is insertable into a key slot, and the key serves as the latch driving device mover. On the inside surface of the door 212, a lock actuator, such as thumb turn 236 may be employed to serve as a latch driving device mover 226 for moving the deadbolt type latch into and out of engagement with the latch receiver 216, and also to move the locking mechanism 210 between the unlocked, normal locked, and emergency locked positions of the locking mechanism 210.

A signal generator 230 which preferably comprises a light display comprising a light strip 230 containing a plurality of LED light elements 252 is disposed on the handle 226 and positioned to shine the light inwardly toward the room that is being secured. A lock actuator such as thumb turn 236 is provided for moving the lock between its three positions.

As best shown in FIGS. 22-24, the thumb turn 236 can be moved into a first position (FIG. 22) for placing the lock in normal position where the outer handle 111 is capable of being moved between an unlocked position to permit the latch 214 to be disengaged from the latch receiver 216. As shown in FIG. 23, the thumb turn is moved to an intermediate position. If the thumb turn 236 is rotated in a direction as shown in Arrow A, the lock will "unlock" an otherwise locked outer handle 111. If the thumb turn is moved in a counter-clockwise direction indicated by Arrow B, the lock will be moved to lock the outer handle 111, prior to the thumb turn 126 placing the lock mechanism 216 in its second emergency position where the outer handle 111 is locked in position and the signal generator 230 is generating a human detectable signal.

A deadbolt type lock typically does not include a spring loaded latch, but has a latch that is either extended out of the locking mechanism or retracted in the mechanism, However, to open the door, the deadbolt type latch is fully retracted, so that moving the latch controlled by the handle 226 to remove the latch 214 from the latch receiver 16 will enable the door 212 to be opened.

FIG. 22 shows the thumb knob 236 in the first, or normal locked position, wherein the outer handle 111 can either be locked to prevent ingress to the secured room, or unlocked to allow ingress. In this position, the signal generator is not generating the signal as it would in an emergency configuration.

Turning now to FIG. 24, the lock 210 is shown in its second, or emergency locked position. In the emergency or locked position, the latch 214 is fixedly positioned, with respect to the locking mechanism 210 to be extended into the latch receiver 216, so that the normal opening and closing movement of the door 212 cannot be accomplished via outside handle 111 because the latch 214 will engage the latch receiver 216 and thereby fail to permit the movement of the door relative to the door frame 218.

Nonetheless, to prevent entrapment, the first handle 226 can be manipulated to open the door 212. Additionally, in the emergency position, a switch member 224 which is coupled between the latch driving device 19 and the LDD 19 mover (here, handle 226) is actuated to form a closed circuit with the power source 242, here shown as a disk-type battery contained in a battery holder, to provide current to the signal generator 230 to illuminate the LED lights 252 of the signal generator 230 to provide a visual indicia that the locking mechanism 212 is properly locked, to help protect the integrity of the room that is sought to be protected.

It is important to note that the door lock mechanism 212 and first side handle 226 that are the primary thrust of the description of this application are disposed on the side of the door that faces the room that is desired to be secured which is designed herein as the first door 212 side. In a typical school type situation, the inside (first) surface 249 of the door 212 will face a classroom that is desired to be secured if an unauthorized intruder enters the school, and the outside surface of the door (not shown) will tend to face the hallway. The difference in treatment between the "secured space" such as the classroom, and the "unsecured space", such as the hallway, causes the secure space lock actuating mechanism 212 to be treated differently than the lock actuating mechanism of the unsecured space.

The primary difference is that the door handle 111 that is mounted to the exterior surface 249 of the door 212 in the unsecured space can only actuate the cylinder 222, to move the latch 214 to thereby permit the door to be open during such times that the lock mechanism, is actuated by the lock actuator 236 to place the locking mechanism in its normal position, such as is shown in FIG. 10. Another way in which the door 212 can be opened, is if a key is provided from the outside of the door that is inserted into the lock mechanism to place the lock mechanism in an unlocked position.

There exists a strong motivation for making the outside handle 111 either incapable of unlocking the locking mechanism 212, or otherwise making the unsecured side of the locking mechanism 212 actuable to unlock the lock only with a key. The motivation is primarily to thwart the intrusion of the secure room by unauthorized persons. It is believed that intrusions will be thwarted because only rarely will unauthorized intruders, such as shooters or terrorists, be in possession of door keys or other devices that will enable the intruder to gain access to a secure room that is locked with the locking mechanism 212 of the present invention.

Therefore, if the locking mechanism 212 can lock the door 212 from the secure room side of the door 212 without the locking mechanism 212 being easily unlockable and the door being not easily openable from the non-secure side of the door 212, it is highly likely that persons within the secure room will be protected against an intrusion from outside the room, absent the intrusion occurring through the physical exertion of some force necessary to either break the door, break a window adjacent to the door, or otherwise break through a wall of the room.

As shown in FIGS. 10 and 11, a plate member 248 engages the secure room facing 249 surface of the door 212 to provide a pleasing, aesthetic appearance, and to cover the "hole" in the door 212 through which the lock driving device 19 extends. Those familiar with door locks will appreciate that often the latch driving device 19 has a diameter that is significantly smaller than the diameter of the door hole through which the latch driving device 19 extends. Therefore, employing the plate 248 or an escutcheon is important for both aesthetic purposes, and also for security purposes, as it prevents one from engaging the internally disposed latch driving device 19 to thereby possibly thwart the security measures built into the latch driving device 19.

A light bar 230 display is disposed on the handle 226 and includes a plurality of LEDs 252 that face outwardly toward the secure room so that the lighted display faces outwardly toward the room so that those within the secure room can view the lighted display 230 to determine when it is on or off.

FIG. 10 shows the door handle 226 in the normal position wherein the lock is unlocked, and the handle is moved to retract the latch 214 from the latch receiver 216. This is as indicated by the position of the thumb turn 386, and by the position of the door handle 226, which is disposed at an oblique angle to horizontal. This is the position one would expect the door handle 226 to be in when one moves the door handle downward (rotates in a counter clockwise direction) to open it. The lock actuating thumb turn 239 is moved so that the proximally disposed stem portion 260 is disposed so that its center of movement is generally colinear with the axis of the latch driving device, and distally positioned pivotal portion 262 is positioned to extend toward the distal or lever 226 end of the handle.

In FIG. 11, the handle 226 is shown in a position where it extends in direction generally perpendicular to the longitudinal extent of the handle 226. In this position, the thumb turn 336 position indicates that the thumb turn 236 is in its second or emergency position. When in this position, the door latch 214 is extended into the latch receiving cavity 216 that is formed as a part of the door frame. A latch receiver plate (not shown) may be coupled to the door frame 218 to provide a reinforced latch receiving cavity 216 for the door frame to make entry through brute force more difficult.

As shown in FIGS. 11 and 24, the lighted display 230 includes LED lights 252 that are illuminated since the door lock 212 is in the emergency locked position.

As best shown in FIG. 21, the thumb turn 236 is shown in the first or normally locked non-emergency position. The thumb turn can be rotated about 180° in a clockwise direction as indicated by arrow A to move the thumb turn 236 and lock mechanism 210 into the intermediate position. From the non-emergency locked position, the thumb turn can be rotated about 270° in a counter-clockwise direction, as indicated by arrow B to move the thumb turn and locking mechanism 210 into the locked and lit and emergency position. Preferably, the lock engages at about 180° of counter-clockwise rotation as shown in FIG. 23, although the light does not come on until the thumb turn 236 has reached position E, approximately 270° counterclockwise from line F (FIG. 21), which represents the normal, non-emergency locked position.

The components of the door handle 226 and lock mechanism 212 of the present invention are best shown in FIGS. 12-15. The handle 226 comprises a metal shell 268, such as a stainless steel, brass, nickel, or brushed aluminum shell 268 that defines a partially hollow interior 270, including a light assembly receiving cavity 274. The inner surface that faces the door includes a cover member 280 which is fixedly attached by screws or other fasteners (not shown) and a tab member 286 to the shell. The upstanding tab member 286 is removable to enable one to gain access to the light assembly receiving cavity 274 and the display assembly components for repair or replacement of the display of assembly components, such as the replacement of the battery 242 when it wears out.

The outer surface 288 of the shell 268 generally includes an opening into which the display member can be placed.

The outer shell 288 also includes a generally cylindrical stem portion that extends in direction generally co-linearly with the latch driving device 19 that actuates the door. The stem housing 260 is finally coupled to the latch drive system 19 so that the rotation of the cylinder stem housing 260 rotates the latch driving device 19 to thereby move the latch 214 into and out of engagement with the lock receiving cavity 216.

The form and shape of the interior surface 298 of the cylindrical stem housing 260 so that the exterior surface provides a clean aesthetically appearing surface, and so that the cylindrical stem housing 260 can receive the distal end (not shown) of the interiorly disposed components 222 of control assembly for the lock driving device 19, which generally includes the pivotal portion 238, retaining clip 301, cam member 304, pin 314, slot 310 and driving blade 239. The external components of the controller/actuator assembly for the latch driving device 19 generally include the handle 226 and the thumb turn knob 236.

The thumb turn lever 236 is coupled to a mechanism contained within the cylindrical housing. The mechanism within the cylindrical housing includes a driving blade 239 which is coupled to the thumb turn lever 236, so that the rotary movement of the thumb turn lever 236 causes rotary movement of the driving blade 239.

A retaining ring clip 301 is coupled to the pivotal portion 238 of the thumb turn 236 to maintain the thumb turn 236 in its proper position. The driving blade 239 is coupled to a cam member 304 which includes a finger-like switch actuator 306 that extends radially outwardly from the cam mechanism 304 and limits the relative rotational movement of the driving blade and cam member 306.

The cam member 304 also includes a slot 310 for receiving a pin 314 that is fixedly coupled to the driving blade 239. The cam member 304 is fixedly coupled to the driving blade 239 so that the cam member 304 is rotationally movable in conjunction with the cam member 304 to move the lock mechanism 210 between the normal and emergency positions. Therefore, when one rotates the thumb turn lever 236, the drive blade 239 is moved, which turns the cam 204 which moves the pin 314 to move the lock mechanism to engage the latch driving device 19 so that the latch driving device 19 is placed in a position where it cannot move in a rotary manner, to thereby maintain the latch 214 within its engagement into the latch receiving cavity 216 that is formed in the door frame 218.

The thumb-like switch actuator 236 that is coupled to the cam 304 is movable between an unengaged position where it does not engage the switch 306, and an engaged position (in the emergency position) wherein the switch actuator 231 engages the switch 306. When the switch actuator 236 engages the switch 306, the switch 306 causes the controller 316 and battery 242 mechanism to be actuated to send a pulse modulated width current to the LED displays, to cause the LED displays that are disposed adjacent to the classroom-facing surface of the inner handle member to become illuminated, and flash in the appropriate manner. Preferably, the controller 316 is mounted onto or printed onto a substrate board 318 to which the battery 242 and signal generating LED array 230 is mounted.

Unlike the device as shown in FIGS. 10 and 11, the thumb turn 236 in FIGS. 12-17, is shown in its normal position and the thumb turn lever 236 is disposed in a position generally parallel to the longitudinal axis of the handle 226 of the lever portion 258.

FIG. 13 provides another illustration of the handle member 226 components, and the relative position of the switch 306, cam 304, and thumb turn 336.

FIG. 15 illustrates the door-facing surface of the handle 226 to show the display assembly components within the interior of the inner handle. The display assembly components include the component board 318, which serves as a substrate on which the battery 242 is mounted and also includes the battery 242, battery holder 244, micro-controller 316, and switch 224. The component board 318 also serves as a substrate on which a micro-controller unit 316 is mounted. The micro-controller unit 316 and battery 242 are in communication with the switch 224. As explained above, the actuation of the switch 224 causes the micro-controller unit 316 to begin communication with the battery 242, and the LED 252 displays. In FIG. 15, the LED displays 252 are not shown, as the LED displays 252 are disposed on the side of the controller board 318 opposite to the side that is shown in FIG. 15.

The reader's attention is now directed to FIG. 17. FIG. 17 shows a version of the handle of the present invention, that is generally similar to the version of the handle shown in the parent case to this continuation-in-part application. A primary difference between the version of FIG. 17 is that it used a magnetic switch 322, 324.

Although the Applicants believe that the embodiment of FIGS. 10-16 is more reliable than the magnetic switch 322, 324 of the embodiment of FIG. 17, the version shown in FIG. 17 is worth reviewing, as it schematically shows the board 316, the battery 242, and the cover 280 from a side view. Additionally, it shows the light board 328 on which the LEDs are mounted that give off the light. Further, it will be noted that a light-diffusing lens 330 is disposed over the LEDs to better help diffuse the light output of the LEDs 252 to make for a better lighted display. Similar to the embodiment of FIGS. 10-16, the FIG. 17 embodiment includes a generally cylindrical stem or shank 256 and a blade 237 and one or more screws 284 to help mount the inner cover 280 onto the shell 26F. As shown in FIG. 17, the hand-tool operable screws couple the inner cover onto the outwardly facing cover, to sandwich together the outer cover, inner cover, board 318, and interior components of the lighted handle display member 224.

Turning now to FIGS. 18 and 19, a mortise type lock 334 is shown with the present invention. One difference between the mortise type lock 334 of the present invention and the cylinder locks of FIGS. 1-17 is that a light bar 338 is fixed onto the escutcheon 340 to which the handle 342 and lock actuating thumb turn 344 are coupled. A mortise type lock 334 differs from the cylindrical lock shown in other embodiments, as the mortise lock 334, when locked, usually both locks into position a spring loaded latch member 346, and also moves into position and locks a deadbolt type latch member 348. Further, the lock actuating thumb turn 344, rather than being mounted on the handle 342 is mounted on the escutcheon 340 and rotates a lock actuating member that is disposed in a generally parallel but non-colinear relationship with the axis of the handle 342 and the latch 346, 348. Nonetheless, the two locks function in a similar manner as turning of the thumb turn 344 into the emergency lock position as shown in FIG. 18, causes the LED light bar 338 to display in a flashing manner to indicate that the emergency lock is locked appropriately. When in the non-emergency position as shown in FIG. 19, the lighted display 338 is turned off and does not flash.

As shown in FIG. 18, the device is shown in the emergency locked position wherein the light is flashing to indicate that it is properly emergency locked.

The mortise lock 334 is also capable of being placed in a third position. The third position is a "non-emergency" locked position. In a non-emergency locked position, the device 334 is locked so that the door cannot be opened from the outside. Nonetheless, since it is a non-emergency position, the light bar is not actuated to flash.

In summary, the mortise lock is also movable between three positions including (1) a first position where the outside handle 111 is locked; (2) a first position wherein the outside handle 111 is unlocked to move the latch unlatched; and (3) an emergency locked position wherein the light bar is actuated to flash. A timer can be added to micro-controller 316 to enable the light to flash for a predetermined period of time, and then shut off so as to preserve battery 242 life.

In order for the door to operate, there must be a micro-controller chip and circuit 316 that is programmable in order to tell the light 352 how and when to flash. The reader's attention is directed to FIG. 17 for review in connection with the discussion below. The chip controller 316 is actuated by the electro-mechanical switch 224 that moves the chip 316 into an "on" position. The chip 316 itself is programmed at the factory to operate as desired. Examples of chips that will work in the present invention are the Nexperio PM065UNE chip. Another chip that will work well is the alpha and omega semiconductor chip number A03414 chip. Other chips will also likely work.

The micro-controller chip 316 is programmed to perform the following functions: The first thing the chip 316 does when it is turned on is to check the battery voltage. The battery voltage is checked because the manner in which the chip 316 will send an "on" signal to the light 230 will vary depending upon the battery voltage that is sensed. In particular, the chip 316 will read the battery voltage and then decide to send an appropriate amount of power from the battery to the light 230. The goal when sending power to the light 230 is to send power to the light 230 so that over the course of the life of the battery and the display event, the light will be perceived as generally constant. It has been found that using a pulse modulated signal will provide such an output display.

One way to visualize this is to consider the time interval between a pair of adjacent pulses. Assume that the rest state of the chip 316 is to not send any power. The controller chip 316 then turns on to send a first pulse, waits for an interval, and then sends a second pulse.

These pulses are sensed in rapid succession, and a visually perceived "flash" usually consists of probably five hundred or so pulses that are delivered. When the output of the battery is high, there is a long relative "off" time between the first and second pulse. However, as the battery life degrades, the "off" time between first and second pulse decreases. By doing this, one has a constant output display.

Additionally, by using the pulsed modulated signal, one significantly increases the battery life. The display created with a pulse modulated signal, as opposed to a constant current type of power protocol to the battery can increase the battery life by ten times. In particular, testing on the present invention suggests that a typical circular coin-shaped "lithium watch battery 242" will have a useful battery life of somewhere around 14 years of normal operation. As discussed below, some models permit the replacement of the battery 242 after the battery becomes degraded.

The chip 316 is programmed to incorporate a protocol that will cause the display to appear the way you desire it to appear. This typically involves programming the chip 316 to cause the light 230 to flash twice in a second. Preferably the chip 316 is programmed off the light 230 after a certain period of time which typically will be 45 minutes. Additionally, the chip 316 can be programmed to send a signal to a communication device which may be part of the micro-controller or else coupled to the micro-controller 316 and then cause the communication device to then send a communication signal to a remote device such as a central unit such as the principal's office that produces a message on an emergency display to indicate to the central command center that the emergency lockdown feature has been activated, or to provide any other desired message.

In an advanced embodiment, the principal might have an indicia that alerts her to the status of the locks of all of the secure spaces in her building, so that the principal would know the state of the locks in all of the secure spaces. In an ideal situation one would have one of these communication capable lock mechanism devices in every classroom in the school so the principal could look at the command display to determine which rooms were locked down and which ones were not locked down. From this information, the principal would be able to send a message to the teacher in any room that was not properly locked down to lock down as soon as possible.

In particular, the intensity of the flash is also governed not just by the programming, but by the particular components that are employed. Through a selection of battery 242 components and the particular LED light bar 252 that is used, one can receive an output that is at the desired level. Preferably the light being used is an LED light bar. The dimensions of the light bar are typically about two inches in length and ⅜" wide. Light bars of this type are available from a variety of commercial sources.

The light not only flashes, but the flashing light can also be programmed to send out information which can be read by a light reader. Examples of the information that can be read include the operating system, the serial number of the light bar, and also information about its use. For example, the information transmitted by the light bar can be read to determine how many times the light has been turned on for a period of more than five minutes. Further, the light flash can give information about battery life, battery strength, and battery voltage.

The controller 316 has some ability to "make judgements" on its own. The primary judgement that the controller 316 makes in how to best maximize flash intensity and manage flash intensity against battery life. As discussed above, turning on the chip 316 causes the chip to first go out and determine the state of the battery 242 and its voltage, and then, through an algorithm, calculates the best mode for flashing the light based upon the power available by the battery.

Preferably, the controller 316 can also sense is when the battery is near its "end of life" position. At that point, the controller 316 will send a signal to the light 320 to change the manner in which the light 320 flashes. This changed manner will indicate to the user that the battery needs to be replaced.

Turning now to the circuit diagram of FIG. 16, the components will be discussed.

The primary component is the microcontroller 316. The microcontroller 316 is one of the models discussed above and is a 6-pin controller. As shown, the controller 316 is a model number ATTINY85V-10SH controller.

A programming port 350 is provided to enable one to program the controller. Although only a 6-pin programming port is necessary, an 8-pin programming port 350 is employed. The reason for using the 8-pin programming port is to provide a free port 354 (here shown as port number 8) that enables one to test the LED 352 using the same port as already exists.

It will be noted that a temporary storage source shown as capacitor C1 352 is disposed in parallel with the battery. The purpose of this capacitor 352 is to provide a "temporary storage source" to take off the sharpness of the vertical drain to prevent a too-sharp of a peak of power being delivered to the LED 352 and possibly damaging the LED 352.

There are two conductors 362, 364 attached to the circuitry 356 that are attached to the switch (not shown) to turn it on and off. The second connector 360 is for connecting to the LED so that the power and signals from the LED can be given to the LED to turn the LED on or off.

A five-ohm resistor 368 is incorporated in the circuit. This resistor 368 is provided as a protector. It is believed by the applicants that a short in the LED 352 could cause a dangerously high amount of voltage to flow through the circuit 356, that could damage the circuit 356. By having a resistor 368, one keeps the circuit 356 from being damaged.

An external switch 370 is provided to increase the power to the LED 352. The external switch 352 is preferably a MOSFET (metal oxide semiconductor field effect transistor) switch.

The circuit may also be electronically coupled to a wireless communication device 373, that may take the form of a WIFI communication device or a Bluetooth communication device. The communication device 373 is configured for sending a communication signal to a wireless network receiver, such as a wireless router, or alternately, to a wireless communications capable device, such as a computer, which can then connect to the WIFI network. The purpose of this communication is to enable the device to communicate the status of the locking mechanism to a remote device, such as a computer in the central office or security office of the school, or even to a more remote device, such as a computer or telephone owned by an emergency response authority, such as a police department, or school security department. The value of this ability to communicate with a remote device, is its ability to alert a remote party of an emergency situation in a more timely manner than would be capable without this communication.

Many schools are very large, and the distance between one end of a school and the other end of the school may be several hundred yards, and a flight or two of stairs. Therefore, if a shooter entered the building at the east end of the building, it might take several minutes for the principal's office at the extreme west end of the building to learn of the shooter's presence. However, with the communication ability of the locking device of the present invention, the placement of the locking mechanism in the emergency lock position would immediately send a signal to the principal's office or the security officers office, so that the principal or security officer could inform the remainder of the building to go into lockdown mode.

Additionally, or alternately, the signal could be sent to a local emergency response team, such as the Police Department. Although normal protocol in an emergency situation would be for the principal to alert the Police Department, the signal being sent by the classroom locking mechanism would provide a backup alert to the principal's office. This backup alert could prove valuable if it were given prior to the principal of the school learning of the emergency situation, and thereby be able to sound the alert to the police.

Additionally, if the shooter rendered the primary alert provider incapable of alerting the police, such as by the shooter disabling the principal's ability to give the alarm to the police, the backup alert given to the police by the locking device of the present invention would still enable an alert to get through to the police, notwithstanding the inability of the Principal to call the police.

While the foregoing written description of the invention enables one of ordinary skill to make and use what is considered presently to be the best mode thereof, those of ordinary skill will understand and appreciate the existence of variations, combinations, and equivalents of the specific exemplary embodiment and method herein. The invention should therefore not be limited by the above described embodiment and method, but by all embodiments and methods within the scope and spirit of the invention as claimed.

The invention claimed is:

1. A locking mechanism for a portal closure that includes a first side, and a second side, the portal closure including a latch movable into and out of engagement with a latch receiver and a latch driving device coupled to the latch for moving the latch into and out of engagement with the latch receiver, the latch driving device including a controllable lock member movable between a locked position where the latch is fixedly positioned in the latch receiver and an unlocked position where the latch is capable of being disengaged from the latch receiver and a second side latch driving device mover disposed on the second side of the portal closure, the locking mechanism comprising:

The first side latch driving device mover disposed on the first side of the portal closures, and coupled to the latch driving device for moving the latch driving device to cause the latch to move into and out of engagement with the latch receiver, a signal generator for generating a human detectable signal;

a lock actuator coupled to the controllable lock member for moving the locking mechanism between a first normal unlocked position wherein the second side lock driving device is capable of being moved between an unlocked position to permit the latch to be disengaged from the latch receiver and a second normal locked position where the latch is placed in a locked position and thereby prevented from being disengaged from the latch receiver, and wherein the signal generator is configured to not generate a human detectable signal; and a third emergency locked position wherein the second side lock driving device is in the locked position, and the signal generator is actuated to generate a human detectable signal;

a power source for powering the signal generatorwhen the locking mechanism is in the third emergency locked position; and a switch coupled between the power source and the signal generator for controlling the flow of current between the power source and the signal generator.

2. The locking mechanism of claim 1 wherein the signal generator comprises a light, and the power source comprises a battery for powering the light.

3. The locking mechanism of claim 2 wherein the latch driving device mover comprises a handle, and the light comprises a light mounted on the handle.

4. The locking mechanism of claim 2 wherein the light comprises a light mounted on a surface of the portal closure.

5. The locking mechanism of claim 4 wherein the locking mechanism includes a first spring biased latch and a second deadbolt latch, and a cover member positioned on a surface of the door adjacent to the first and second latches, the light comprising an array of LED type lights coupled to the cover member.

6. The locking mechanism a claim 1 wherein the latch driving device mover comprises one of a door handle, door knob and the lock actuator, the portal closure comprises a door, and the power source for powering the signal generator, comprises a battery.

7. The locking mechanism of claim 1 wherein the signal generator comprises a light mounted on the portal closure, and the power source comprises a battery, further comprising a controller for controlling the operation of the signal generator, the controller including a timer for de-activating the signal generator after a predetermined time period.

8. The locking mechanism of claim 1 wherein the latch driving device sensor includes a driving blade engageable with the latCh driving device, and the lock actuator includes a cam member including a switch actuator for actuating the switch to allow power to flow between the power source and the signal generator when the lock actuator is in the third emergency locked position.

9. The locking mechanism of claim 8 wherein the earn member includes a slot for receiving a pin coupled to the driving blade for limiting the relative movement of the driver blade and lock actuator.

10. The locking mechanism of claim 9 wherein the switch actuator comprises a radially outwardly extending finger-like member.

11. The locking mechanism of claim 8 wherein the switch actuator comprises a radially outwardly extending finger of the cam member for engaging the switch.

12. The locking mechanism of claim 1 wherein the lock actuator is rotated about 180° in a first direction to move from the first normal unlocked position to the second normal locked position wherein the portal closure is locked, and then rotated at least about another 20° to the third emergency position where the signal generator is actuated to generate a human detectable signal.

13. The locking mechanism of claim 1 wherein the signal generator comprises a light configured to flash at a predetermined interval for providing visual contrast to the observer.

14. The locking mechanism of claim 1 further comprising a programmable controller for controlling the operation of the signal generator, the controller being programmable for co oiling light brightness, flash interval and duration of the signal generated and for increasing battery life.

15. The locking mechanism of claim 1, wherein the signal generator comprises an LED containing light bar having a diffusing lens for increasing light brightness and contrast.

16. The locking mechanism of claim 1, wherein the signal generator comprises a light display further comprising a controller coupled to the signal generator and configured for levelizing apparent brightness of the light display.

17. The locking mechanism of claim 1 further comprising a controller coupled to the signal generator for sending a signal to be broadcast by the signal generator that the power source was low.

18. The locking mechanism of claim 1 wherein the lock actuator comprises at least one of a thumb turn, knob, pushable button, or key head.

19. The locking mechanism of claim 1 wherein the signal generator comprises a flashing light, further comprising a controller configured for controlling the operation of the flashing light in a manner wherein the flashing light conveys information to a reader device relating to at least one of power source life, number of activations, firmware version, or diagnostic information.

20. The locking mechanism of claim 1 wherein the signal generator comprises a communication signal generator capable of transmitting the signal so generated to a remote device.

21. A locking mechanism for a door, having a first side and a second side the locking mechanism comprising a second side turnable handle disposed on the second side of the door, a first side turnable handle having a housing, a turnable lock actuator and a lighted display assembly that includes an illuminated member that activates when the locking mechanism is locked from the first side of the door by rotating the turnable lock actuator manually into the locked position; the display assembly includes a power source, a controller for controlling the operation of the device, a lighted member for emitting light in response to being turned on, a switch member for connecting and disconnecting the illuminated light source from power, wherein the turnable lock actuator is configured for manually moving the locking mechanism between a first normal unlocked position wherein the second side handle is capable of moving the latch between an engaged and a disengaged position in the latch receiver to permit the latch to be disengaged from the latch receiver and a second normal locked position wherein the latch is placed in a locked position in the latch receiver, and is thereby prevented from being disengaged from the latch receiver and wherein the signal generator is configured to not generate a human detectable signal; and a third emergency locked position where the second side lock driving device is in the locked position, the latch is engaged with the latch receiver and the signal generator is actuated to generate a human detectable signal.

22. A door lock comprising a latch driving device including an inner operating device and an outer operating device coupled with the inner operating device;

a latching device coupled with the inner operating device and the outer operating device, wherein the latching device includes a latch movable between an unlatching position and a latching position;

an outer handle operatively coupled to an outer side of the outer operating device, wherein the outer handle is pivotable to move the latch to the unlatching position;

at inner handle including a shank interlocked with the inner operating device and a lever extending from the shank, wherein the shank includes a pivotal hole extending from an end face thereof, and wherein the lever includes a chamber intercommunicating with the outer groove;

a lighting device received in the chamber of the inner handle, wherein the lighting device includes a lighting element facing the outer surface and a switch controlling lighting of the lighting element;

a first lid that is transmittable to light, and wherein the lighting element is configured to generate light transmitting through the first lid;

a thumb pivotably coupled with the pivotal hole of the inner handle and interlocked with the latch driving device, wherein the thumb turn includes an actuator controlling the switch to a conductive state or a non-conductive state, wherein the thumb turn is pivotable for moving the latch between a first normal unlocked position where the outer operating device is capable of moving the latch between an engaged position and a disengaged position with respect to the latch receiver, and a second normal locked position where the latch is prevented from being disengaged from the latch receiver; and a third emergency locked position where the second side lock driving device is in the locked position and the signal generator s actuated to generate a human detectable signal by the lighting element generating light transmitting through the first lid.

* * * * *